US012078085B2

(12) United States Patent
Olivotti

(10) Patent No.: US 12,078,085 B2
(45) Date of Patent: Sep. 3, 2024

(54) COMBINED THERMODYNAMIC CYCLE WITH HIGH ENERGY RECOVERY

(71) Applicant: I.V.A.R. S.P.A., Prevalle (IT)

(72) Inventor: Sergio Olivotti, Altavilla Vicentina (IT)

(73) Assignee: I.V.A.R. S.P.A., Prevalle (IT)

( * ) Notice: Subject to any disclaimer, the term of this patent is extended or adjusted under 35 U.S.C. 154(b) by 187 days.

(21) Appl. No.: 17/640,733

(22) PCT Filed: Sep. 3, 2020

(86) PCT No.: PCT/IB2020/058210
§ 371 (c)(1),
(2) Date: Mar. 4, 2022

(87) PCT Pub. No.: WO2021/044338
PCT Pub. Date: Mar. 11, 2021

(65) Prior Publication Data

US 2022/0325637 A1 Oct. 13, 2022

(30) Foreign Application Priority Data

Sep. 6, 2019 (IT) ..... 102019000015770
Sep. 6, 2019 (IT) ..... 102019000015776

(51) Int. Cl.
*F01K 21/04* (2006.01)

(52) U.S. Cl.
CPC ..... *F01K 21/04* (2013.01)

(58) Field of Classification Search
CPC ..... F01K 21/04; F01K 23/08; F01K 25/04; F01K 25/10; F01K 3/262; F01K 7/36; F01K 25/103; Y02E 20/16
See application file for complete search history.

(56) References Cited

U.S. PATENT DOCUMENTS 7,926,276 B1 4/2011 Dunn
9,624,793 B1 4/2017 Pasch
(Continued)

FOREIGN PATENT DOCUMENTS

DE 2345420 A1 4/1975
DE 3605466 A1 8/1987
(Continued)

OTHER PUBLICATIONS

Search Report dated Apr. 30, 2021 in corresponding International Application No. PCT/IB2020/058210, 6 pages.
(Continued)

*Primary Examiner* — Shafiq Mian
(74) *Attorney, Agent, or Firm* — MH2 TECHNOLOGY LAW GROUP LLP

(57) ABSTRACT

A new combined SEOL cycle is represented by the recovery vapor Generator (GVR) which completely substitutes the Regenerator, of the prior art, being capable of recovering the energy differential ($Q_R$) between the temperature at the end of expansion and the temperature at nearly complete condensation of the thermal fluid and then, by using this great energy differential, it is capable of producing water vapor, entirely reusable in the preheating of the mixture, considerably contributing to the increase of the overall energy yield of the cycle and to the increase of the unit power of the heat engine.

15 Claims, 10 Drawing Sheets

(56) References Cited

U.S. PATENT DOCUMENTS

| | | | | |
|---|---|---|---|---|
| 2015/0345341 | A1* | 12/2015 | Kacludis | F01K 25/103<br>60/671 |
| 2020/0370502 | A1* | 11/2020 | Mook | F02G 1/044 |
| 2022/0403760 | A1* | 12/2022 | Nasini | F01K 23/08 |

FOREIGN PATENT DOCUMENTS

| | | | | |
|---|---|---|---|---|
| EP | 2574738 | A1 | 4/2013 | |
| WO | WO-2005031122 | A1 * | 4/2005 | F01K 21/04 |
| WO | 2013042142 | A1 | 3/2013 | |
| WO | 2014124061 | A1 | 8/2014 | |

OTHER PUBLICATIONS

Written Opinion dated Apr. 30, 2021 in corresponding International Application No. PCT/IB2020/058210, 10 pages.

* cited by examiner

COMBINED THERMODYNAMIC CYCLE WITH HIGH ENERGY RECOVERY

CROSS-REFERENCE TO RELATED APPLICATIONS

This application is a U.S. National Stage application of PCT/IB2020/058210 filed Sep. 3, 2020, pending, which claims priority to Italian Patent Application No. 102019000015770 filed Sep. 6, 2019 and to Italian Patent Application No. 102019000015776 filed Sep. 6, 2019, the entire disclosures of which are hereby incorporated by reference in their entireties.

BACKGROUND

The object of the present invention, in one of its aspects, is a new thermodynamic cycle, termed with the acronym "SEOL", where the absolute novelty is represented by the recovery vapor Generator (GVR) which completely substitutes the Regenerator of the prior art and is capable of recovering nearly all the energy differential of the thermal fluid at the end of expansion ($Q_R$), through the production of overheated water vapor which is then injected and mixed with the other circulating gases, decisively contributing to the increase of the overall energy yield of the cycle and to the increase of the unit power of the heat engine.

In particular, the present invention can have considerable application in the production of electrical energy from renewable sources, in the field of combined generation of electrical energy and heat, in the field of vehicles/transportation and in the motor field in general, being able to decisively contribute to the reduction of the atmospheric pollution.

The present invention termed: "new combined SEOL cycle", regards a great function simplification of the cycle already claimed in the patent application WO-2019/008457-A1, published in the name of the same Applicant. Overall, over time, heat engines have been developed that are operating with different thermodynamic cycles, and others are still in testing phase. However, it is possible to observe that the solutions that have been industrialized up to now have many limitations. This is particularly true for the small heat engines used for driving autonomous electric generators of small-medium power (below 50 KWh):

A_ reciprocating endothermic engines with Diesel cycle or Otto cycle, which are mechanically complicated, noisy, particularly polluting and require considerable maintenance;

B_ Stirling exothermic engines which, even if less polluting than the endothermic engines, possess low unit power, have low yields and are very heavy and bulky;

C_ Ericsson exothermic engines which, even if capable of having overall yields that are theoretically considerable, are conditioned by the presence of load/discharge valves, and at the current state of the art they have not yet had industrial applications;

D_ turbine endothermic engines (with gas or other fuels), which in the small size versions are particularly polluting and not very competitive;

E_ steam exothermic engines (operating with Rankine or Rankine Him cycle), of various type, which can only be competitive in fixed cogeneration applications of a certain size.

At the state of the art, some types of endothermic engines (with internal combustion), of the prior art, with suitable mechanical and functional modifications, can be adapted for the use of the "new combined SEOL cycle"; in particular, as a non-limiting example, we list the following:

A_ four-stroke Diesel reciprocating engine;

B_ four-stroke Otto reciprocating engine;

C_ four-stroke Wankel rotary engine;

D_ four-stroke Quasiturbine rotary engine (patent US-2014-0140879-A1);

At the state of the art, some other types of exothermic engines (with external combustion), of the prior art, with small functional variants, can be easily adapted for the use of the "new combined SEOL cycle"; in particular, as a non-limiting example, we list the following:

A_ rotary engine RVE, formed by a Suction-Compression (1') section and by one or two Expansion-Discharge (3') sections, delimited by four or six slidable pistons, with periodically variable speed, within a single annular cylinder, as already claimed in the patent applications: WO-2015/114602-A1, WO-2019/008457-A1, published in the name of the same Applicant;

B_ Ericsson reciprocating engine with two cylinders;

C_ Wankel rotary engine, formed by a compressor (1') and by an expander (3'), mechanically connected to each other by means of any one transmission system (patent: U.S. Pat. No. 3,426,525);

D_ Palette rotary engine, formed by a compressor (1') and by an expander (3'), mechanically connected to each other by means of any one transmission system (patent: DE-43.17.690-A1);

E_ Trefoil rotary engine; formed by a compressor (1') and by an expander (3'), mechanically connected to each other by means of any one transmission system (patent: US-2011-0259002-A1);

F_ RVE rotary engine, formed by a compressor (1') and by an expander (3'), mechanically connected to each other by means of any one transmission system (patent: WO-02/084078-A1);

G_ Scroll rotary engine, formed by a compressor (1') and by an expander (3'), mechanically connected to each other by means of any one transmission system (patent: US-2005/0172622-A1);

H_ rotary engine with multistage Turbine, formed by a Compressor (1') and by an expander (3'), mechanically connected to each other by means of any one transmission system (patent: WO-2012/123500-A2).

In general, all the known motor solutions, mainly due to their low overall yield, have a cost-benefit ratio that is not very satisfactory, which has very much limited the diffusion of cogeneration in the market of apartment buildings and civilian homes.

If it is desired to extend the use of new heat engines also to vehicles/transportation, the compactness and overall efficiency of the same are essential and therefore, in such context, the Applicant with the present invention has set the objective of proposing a new thermodynamic cycle.

In the already known external combustion heat engines, the Regenerator, normally used, only allows recovering the energy differential existing between the temperature of the thermal fluid at the end of expansion ④ and the temperature at the end of compression ②, i.e.: a relatively low differential (e.g. T4: 360° C.-T2: 276° C.=84° C.) which, in some case, can even result negative. The absolute novelty of the new combined SEOL cycle is represented by the function performed by the recovery vapor Generator (GVR) which completely substitutes the Regenerator and is capable of recovering the energy differential ($Q_R$) between the temperature of the thermal fluid at the end of expansion ④ and the temperature of the same at nearly complete condensation (measured on the pipe 14'), i.e.: a very high differential (e.g. T4: 360° C.-T14: 40° C.=320° C.). By using said great energy differential ($Q_R$) the recovery vapor Generator "GVR" is capable of producing overheated water vapor, entirely reusable in the cycle.

With the use of the new combined SEOL cycle, it is possible to obtain the following main advantages:

A_ increase of the unit power of the heat engine, due to the increase of enthalpy of the mixture (Air and/or Helium and/or another compatible gas, mixed with Overheated water vapor) which is introduced in the Expander (ES);

B_ considerable increase of the overall thermal yield, following the energy recovery ($Q_R$) that takes place in the recovery vapor Generator (GVR);

C_ possibility of lubricating the cylinders and/or the sliding chambers of the pistons of the heat engine, of the prior art, with decrease of the mechanical friction and of the wear and consequent increase of the overall yield of the engine itself;

D_ possibility of using multiple heat sources ($Q_H$), capable of heating to a sufficient temperature the mixture circulating in the Superheater (SR).

E_ possibility of designing and industrializing new "heat engines" characterized by high overall yields and reduced production costs.

With reference to FIG. 1, the new combined SEOL cycle is mainly composed of the following components:

A_ a Compressor "CO", having the object of suctioning ① and compressing ② the gaseous fluid (Air and/or Helium and/or another compatible gas), being part of the mixture;

B_ a Check valve "VNR", having the object of preventing, in any case, the compressed gaseous fluid from circulating in the sense opposite the regular motion;

C_ a Mixing box "CM", having the object of receiving the compressed gases, coming from the Compressor "CO", and of mixing them with the overheated water vapor, coming from the recovery vapor Generator "GVR";

D_ a Superheater "SR" which, by means of bringing thermal energy ($Q_H$), has the object of overheating the mixture coming from the Mixing box "CM" in order to render it usable in the cycle;

E_ an Expander "ES", capable of receiving from the Superheater "SR" the overheated mixture ③ and making it expand ④, removing heat-energy therefrom and producing the useful mechanical work of the cycle "$L_E$";

F_ a recovery vapor Generator "GVR" (the most significant component of the new combined SEOL cycle), capable of removing the residual thermal energy ($Q_R$) still contained in the mixture, discharged from the expander "ES", and using it for generating overheated water vapor to be reintroduced into the cycle;

G_ a Condenser "CD", having the object of removing the residual energy ($Q_{LR}$) from the mixture so as to complete the condensation of the mixture at low temperature, which is discharged from the recovery vapor Generator "GVR";

H_ a Separator "SA", having the object of separating the gaseous part of the mixture (Air and/or Helium and/or another compatible gas) from the liquid part (condensation water), so as to render them separately usable in the cycle;

I_ a metering Pump "PD", provided with a flow rate Regulator "RA", having the object of suctioning from the separator "SA" a predetermined quantity of condensation water and pumping it, at high pressure, into the recovery vapor Generator "GVR";

J_ an Electric Generator "GE", capable of transforming the mechanical Work "$L_E$" produced by the Expander "ES" into electrical energy, also being arranged for performing the function of starting motor in the initial step of starting the heat engine.

In the diagram of FIG. 1, the represented heat engine is substantially formed by the Compressor "CO" and by the expander "ES", mechanically connected to each other by means of the drive shaft (2'); however, without at all negatively affecting the invention, the new combined SEOL cycle can be used with any one other engine of the prior art (with reciprocating or rotary motion), capable of jointly or separately making the necessary Suction/Compression functions and Expansion/Discharge functions; also without at all negatively affecting the invention, many other different technical solutions could be used, aimed for attaining said functions in any manner.

With reference to the diagram of FIG. 1, it is deemed opportune to provide the following important specifications regarding the step of preparing the closed circuit, within which the operating fluids flow:

A_ by means of the Generator "GE" (used as starting motor), the heat engine is set at very slow rotation and, by using the separate bombs of compressed gases and the suitable load outlets (not represented in the diagram), the single gases (Air and/or Helium and/or another compatible gas) are introduced into the closed circuit of the system in the predetermined proportions, up to reaching a certain overpressure (0.1÷0.2 Bar), with respect to the atmospheric pressure;

B_ maintaining the engine in motion (as in the preceding paragraph A): also the metering Pump "PD" is activated at the minimum flow rate and then, by making use of a suitable raised container, provided with needle valve, a predetermined quantity of distilled Water is introduced within the circuit, in a manner such that on the bottom of the Separator "SA" (possibly graduated), a quantitative reserve of condensation water is always present, such to be able to ensure the triggering of the same metering Pump "PD" and the expected maximum flow rate in the maximum use condition;

C_ the flow rate of the metering Pump "PD" is automatically adjusted, by the Regulator "RA", for the purpose of bringing to the cycle the precise quantity of condensation water necessary for allowing the recovery vapor Generator "GVR" to recover the maximum energy possible ($Q_R$), in the various operating conditions;

D_ independent of the availability of electrical energy, normally obtainable with the electric Generator "GE", the electrical energy necessary for the motor starting phase and in order to feed the auxiliary instrumentation is supplied by a normal electrical storage battery with sufficient capacity.

With reference to the diagram of FIG. 1, the starting of the heat engine is preferably attained in the following manner:

A_ by means of the electric Generator "GE", used as starting motor, and by means of the drive shaft (2'), the Compressor "CO" and the expander "ES" are rotated at a minimum predetermined speed (e.g. 400 revolutions/m);

B_ at said rotation speed, the Compressor "CO", by means of the pipe (18'), suctions ① from the Separator "SA" the gaseous fluid (Air and/or Helium and/or another compatible gas) and compresses it ②, up to a specific pressure value (e.g. 4 Bar), which corresponds with a proportional temperature (e.g. 163° C.);

C_ the gas thus compressed moves into the pipe (5'), traverses the Check valve "VNR", moves into the pipe (7'), arrives in the Mixing box "CM" (where, in the initial step, only gaseous fluid circulates), moves into the pipe (9'), before then reaching the Superheater "SR";

D_ following the starting of the compressor "CO", also the heat source "$Q_H$" is activated and the same is adjusted such that at the outlet of the Superheater "SR", in the pipe (11'), the gaseous fluid reaches the minimum predetermined temperature (e.g. 400° C.);

E_ said heated gaseous fluid is conveyed into the Expander "ES" where, being expanded from the state ③ of maximum pressure (e.g. 4 Bar) and maximum temperature (e.g. 400° C.) to the state ④ of minimum pressure (e.g. 1 Bar) and average temperature (e.g. 180° C.), it produces the useful Work "$L_E$", then having at the discharge, in the pipe (12'), a temperature that is still high (e.g. 160° C.) and a quantity of thermal energy nearly entirely usable;

F_ when the already-expanded gaseous fluid reaches, in the pipe (12'), the predetermined minimum temperature (e.g. 120° C.) useful for producing water vapor, then the metering Pump "PD" is activated, adjusted to a predetermined minimum flow rate and calibrated to a predetermined delivery pressure (e.g. 20 Bar);

G_ following the activation of the metering Pump "PD", by means of the pipe (19'), the programmed quantity of condensation water is drawn into the Separator "SA", at ambient temperature (e.g. 20° C.), and then, by means of the pipe (22'), the same is conveyed, at high pressure, towards the recovery vapor Generator "GVR";

H_ in the recovery vapor Generator "GVR", which acts as countercurrent heat exchanger, the thermal energy still possessed by the mixture ($Q_R$) discharged from the Expander "ES" is used for vaporizing the condensation water coming from the metering Pump "PD" before then, by means of the pipe (23') and the injector (24'), moving the overheated water vapor into the Mixing box "CM", where the overheated water vapor is mixed with the gaseous fluid coming from the Compressor "CO";

I_ the ideal energy recovery condition would be that in which the temperature of the fluid, exiting from the recovery vapor Generator "GVR", measured on the pipe (14'), was equal to a value as close as possible to the ambient temperature (20° C.). Given however that this condition, due to heat exchange considerations, is hard to attain, the presence of the condenser "CD" is thus provided which has the object of dispersing the residual energy ($Q_{LR}$) in order to reduce, in each case, the temperature of the thermal fluid exiting from the recovery vapor Generator "GVR" to the level of the ambient temperature;

J_ in the Separator "SA", the gaseous part of the mixture (Air and/or Helium and/or another compatible gas) is separated from the liquid part (condensation water), so as to render them separately available for the continuity of the cycle;

K_ when the overheated mixture which enters into the Expander "ES" arrives at a certain temperature and the thermal drop between the inlet and the outlet of the same Expander exceeds a specific minimum value, i.e.: when the produced useful Work "$L_E$" exceeds the value of the mechanical strength due to the compression "$Q_C$" summed with the mechanical friction, then the heat engine is capable of operating with its own motion and the electric Generator "GE" can stop operating as starting motor and start operating as electric Generator;

L_ once the heat engine operates with its own motion: by gradually increasing the quantity of energy supplied to the system "$Q_H$", a gradual increase of the temperature of the mixture that moves in the pipe (11') is determined up to the allowed maximum (e.g. 900° C.)

M_ the higher temperature mixture that enters into the Expander "ES" determines an increase of the number of revolutions (e.g. from 400 to 900 revolutions/m) of the engine and a nearly proportional increase of the produced useful Work "$L_E$";

N_ at the aforesaid rotation speed, the Compressor "CO", by means of the pipe (18'), suctions ① from the Separator "SA" the gaseous fluid and compresses it ② to a higher pressure value (e.g. from 4 to 9 Bar), which corresponds with a proportional increase of temperature at the end of compression (e.g. from 163° C. to 276° C.);

O_ in said operating conditions, the mixture discharged from the Expander "ES" possesses an even higher temperature (e.g. 353° C.) with an energy differential ($Q_R$) nearly entirely recoverable in the recovery vapor Generator "GVR", as already described above.

Further aspects of the present invention are described hereinbelow.

The object of the present invention is a heat engine, comprising a drive unit provided with motion transmission system, and a combined thermal cycle, operating with a mixture of gas and water vapor, with the object of obtaining greater unit power, a considerable increase of the overall yields and an efficient lubrication of the movable parts of the drive unit. The present invention also regards a method for attaining thermal cycles. The heat engine is generally employable for the production of mechanical energy. The present invention has particular application in the production of electrical energy in generation plants, or in the combined production of electrical and thermal energy by means of cogeneration and microcogeneration plants. In addition, the present invention can be applied in the field of vehicles/transportation and in the motor field in general. Some historical considerations regarding thermodynamic cycles, as well as some known solutions, are described in the patent applications published with the numbers WO2015/114602A1 and WO2019/008457, in the name of the same Applicant.

Overall, heat engines have been developed that are operating with different thermodynamic cycles and others have been developed that are still in testing phase.

However, the applicant has found that even the previously industrialized solutions have many limitations. This is in particular true for the engines employed for driving autonomous electric generators of small-medium power (e.g. below 50 KWh).

In the present practical reality, for the driving of electric generators, the following drive units are normally used:

reciprocating endothermic engines, which are mechanically complicated, noisy, particularly polluting and require considerable maintenance;

Stirling engines which, even if less polluting, in order to have a good overall yield must typically operate at low speed and hence are very heavy and bulky;

gas turbines, which in addition to being particularly polluting, are not economically competitive in small size versions;

expanders, operating with Rankine or Rankine-Hirn cycle, which, given the need to have to use a vapor generator of a certain size, are particularly competitive only in fixed cogeneration applications and require further innovative technologies in order to be more efficiently used, even in movable small-size applications.

The Applicant has nevertheless found that the known solutions are not free of drawbacks and can be improved with regard to various aspects.

Indeed, in general all the known solutions, in addition to problems of pollution, low yield, mechanical complexity and high maintenance costs, also have a cost-benefit ratio that is not particularly satisfactory, which has very much limited the diffusion of cogeneration in apartment building and civilian home market.

The Applicant has also observed that if it is desired to extend the use of such heat engines to vehicles/transportation and to microcogeneration in home environments, the compactness and overall efficiency of the same are essential.

In this situation the object underlying the present invention, in its various aspects and/or embodiments, is to provide a connector for the connection of pipes which can be capable of overcoming one or more of the abovementioned drawbacks.

In particular, the Applicant has set the objective of proposing a new "heat engine" capable of functioning with an innovative combined gas and water thermal cycle, by means of which it is possible to make use of more energy, recovering it in the same steps of the cycle, with considerable increase of the unit power and of the overall yield, also resolving the big problem of lubrication of the movable parts of the drive unit.

Another object of the present invention is to make a heat engine which has a high operating reliability.

Further object of the present invention is to provide a heat engine characterized by a simple and rational structure.

Further object underlying the present invention, in its various aspects and/or embodiments, is that of overcoming one or more of the disadvantages of the known solutions, by providing a new "heat engine", capable of using multiple thermal sources and capable of generating mechanical energy (Work), that can be used in any place and for any use, and preferably for the production of electrical energy.

A further object of the present invention is to provide a heat engine characterized by a high thermodynamic yield and by an optimal weight-power ratio.

A further object of the present invention is to be able to make a heat engine characterized by a reduced production cost.

Further object of the present invention is to create alternative solutions, with respect to the prior art, in making heat engines, and/or opening new design fields.

Such objects, and other possible objects, which will be clearer in the course of the following description, are substantially achieved by a heat engine according to one or more of the enclosed claims, each of which taken separately (without the relative depending claims) or in any combination with the other claims, as well as according to the following aspects and/or embodiments, variously combined, also with the aforesaid claims.

SUMMARY

Aspects of the invention are listed hereinbelow.

In a first aspect thereof, the invention regards a heat engine configured for attaining a thermal cycle, the heat engine operating with a thermal fluid and comprising a drive unit and a drive circuit.

In one aspect the drive unit comprises:

a case delimiting at least one operative chamber at its interior;

members for transforming the energy of said thermal fluid, movably housed within said at least one operative chamber and configured for transforming the energy of said thermal fluid into mechanical energy, according to an operative cycle;

an output shaft operatively connected to said energy transformation members and configured for receiving said mechanical energy and providing a rotary motion at the outlet, preferably with constant angular speed.

In one aspect the case, delimiting said at least one operative chamber at its interior, has:

a first inlet in fluid communication with a first inlet duct in order to receive therefrom a flow of said thermal fluid being suctioned into said at least one operative chamber;

a first outlet in fluid communication with a first outlet duct in order to send thereto a flow of said thermal fluid under compression exiting from said at least one operative chamber;

a second inlet in fluid communication with a second inlet duct in order to receive therefrom a flow of said thermal fluid being loaded to be expanded in said at least one operative chamber;

a second outlet in fluid communication with a second outlet duct in order to send thereto a flow of said thermal fluid being discharged exiting from said at least one operative chamber.

In one aspect the drive circuit is extended between said first inlet and second inlet and said first outlet and second outlet and comprises said first inlet duct, said first outlet duct, said second inlet duct and said second outlet duct.

In one aspect the drive circuit attains a continuous cycle of thermal fluid flow through said at least one operative chamber of the drive unit, in which:

said second outlet duct starts from said second outlet of the case of the drive unit and terminates, being continuously connected with (i.e. it flows into the start of) said first inlet duct, the latter terminating in said first inlet of the case of the drive unit, the second outlet duct and the first inlet duct attaining a first closed branch of the drive circuit;

said first outlet duct starts from said first outlet of the case of the drive unit and terminates, being continuously connected with (i.e. it flows into the start of) said second inlet duct, the latter terminating in said second inlet of the case of the drive unit, the first outlet duct and the second inlet duct attaining a second closed branch of the drive circuit.

In one aspect the heat engine comprises a heater that is operatively active, along said second closed branch of the drive circuit, between said first outlet duct and said second inlet duct, configured for heating the thermal fluid circulating in the second branch.

In one aspect the heat engine comprises a condenser that is operatively interposed along said first closed branch of the drive circuit, between said second outlet duct and said first inlet duct, configured for cooling the thermal fluid circulating in the first branch.

In one aspect the heat engine comprises a condensation separator, placed downstream of the condenser along said first inlet duct, where the water present in the thermal fluid is condensed and separated from the air, before the thermal fluid reaches said first inlet for suctioning into said at least one operative chamber.

In one aspect the heat engine comprises a pump (preferably at high pressure), configured for drawing the condensation water previously extracted from the air by means of the condensation separator and for sending it into a vaporization pipe flowing into said second branch, at a point of said first outlet duct upstream of said heater.

In one aspect the heat engine comprises a vaporizer, situated in the heat engine in a manner such to intercept, on a high-temperature side thereof (or first side), said second outlet duct downstream of the drive unit and upstream of the condenser and, on a low-temperature side thereof (or second side), said vaporization pipe.

In one aspect the vaporizer is configured for heating and vaporizing the condensation water circulating in said vaporization pipe before it flows into said second branch.

In one aspect the heat engine comprises an injector, placed at the end of said vaporization pipe and configured for injecting into the second branch, upstream of the heater, a predefined quantity of water vapor, capable of increasing the unit power of the drive unit and of ensuring the lubrication of said energy transformation members movably housed in said at least one operative chamber.

In one aspect the vaporizer is operatively interposed, on the low-temperature side thereof, between said pump at high pressure and said injector, and is operatively interposed, on the high-temperature side thereof, between the second outlet of the drive unit, which expels spent thermal fluid, and the condenser, in a manner such that the vaporizer acquires residual energy-heat from the spent thermal fluid and uses it for preheating the thermal fluid moving towards the heater.

In one aspect the vaporizer is a heat exchanger.

In one aspect the vaporizer is a heat exchanger provided with two sides which intercept—respectively—the second outlet duct and the vaporization pipe, in a manner such to transfer heat from the thermal fluid circulating in the second outlet duct to the fluid (water) circulating in the vaporization pipe.

In one aspect the vaporizer determines a cooling of the thermal fluid circulating in the second outlet duct and a corresponding (in thermodynamic terms) heating of the fluid circulating in the vaporization pipe.

In one aspect the heat engine comprises a compensation tank positioned downstream of said first outlet of the drive unit along said first outlet duct and configured for storing the compressed thermal fluid in order to make it available for the subsequent use thereof, in order to balance and optimize the thermal fluid flow circulating in said drive circuit.

In one aspect the heater comprises a burner with enclosed combustion chamber, said burner being adapted to be power supplied with a plurality of fuel types and being configured for supplying to the heater the thermal energy necessary for the operation thereof.

In one aspect the heater comprises an injection valve configured for managing, in a controlled manner, the introduction of fuel in order to feed said burner.

In one aspect, said heater comprises a containment body provided with an inlet for comburent air, drawn from the environment, and housing both said burner, operatively active along said second closed branch of the drive circuit, and said condenser, operatively active along said first closed branch of the drive circuit, in a manner such that the heat drawn from said first branch by means of the condenser is transferred to the comburent air before this reaches the burner, facilitating the process of combustion and heating of the thermal fluid in the second branch.

In one aspect the heat engine comprises a superheater positioned downstream of said burner in order to remove energy from the hot combustion fumes of the burner, and configured for intercepting said vaporization pipe in a position downstream of said low-temperature side of the vaporizer and upstream of said injector.

In one aspect said superheater is configured for transferring the energy removed from the hot combustion fumes of the burner to the condensation water vaporized at the outlet from the vaporizer, in a manner such to overheat it before it reaches the injector.

In one aspect the heat engine is provided with a closed cooling circuit, separate from said drive circuit.

In one aspect the cooling circuit comprises a first heat recuperator, situated in the containment body of the heater in a position downstream of the condenser and upstream of the burner, with respect to the direction of the comburent air flow in the heater.

In one aspect the cooling circuit comprises a cooling unit (interspace) operatively associated with the case of the drive unit.

In one aspect the cooling circuit comprises a plurality of cooling pipes connecting in series, to form a circular path, said first heat recuperator and said cooling unit, said cooling pipes carrying a quantity of cooling fluid (preferably water).

In one aspect said cooling pipes are arranged in the heat engine in a manner such to:

- interact with said cooling unit, where the low-temperature cooling fluid draws heat from the case of the drive unit, cooling it, and consequently it is brought to high temperature, and
- interact with said first heat recuperator, where the high-temperature cooling fluid transfers heat to the comburent air flow, heating it, and consequently returns to low temperature.

In one aspect the cooling circuit comprises a cooling pump, placed in said cooling circuit and operatively active on a pipe of said plurality of cooling pipes for determining a circulation of said cooling fluid in the cooling circuit. In one aspect, said cooling circuit comprises a second heat recuperator, situated in the containment body of the heater in a position downstream of the burner, and preferably downstream of said superheater, along the outlet path of the hot combustion fumes of the heater.

In one aspect said plurality of cooling pipes connects in series, in said circular path, said first heat recuperator, said cooling unit and said second heat recuperator, the latter being interposed downstream of the cooling unit and upstream of the first heat recuperator, along the travel direction of the cooling fluid, in a manner such that:

- in said cooling unit, the low-temperature cooling fluid draws heat from the case of the drive unit, cooling it, and consequently it is brought to high temperature;
- in said second heat recuperator, the high-temperature cooling fluid acquires heat from the hot combustion fumes, cooling them, and consequently undergoes a temperature increase;
- in said first heat recuperator, the high-temperature cooling fluid transfers heat to the comburent air flow, heating it, and consequently returns to low temperature.

In one aspect:

said first recuperator is configured for cooling said cooling fluid by transferring heat/energy to said comburent air;

said cooling unit is configured for cooling the drive unit by means of transfer of heat/energy from the drive unit to the cooling fluid, which undergoes a temperature increase;

said second recuperator is configured for heating said cooling fluid by acquiring heat/energy from the hot combustion fumes.

In one aspect the heat engine is provided with an auxiliary hydraulic circuit comprising an auxiliary recuperator, situated in the containment body of the heater in a position downstream of the burner, and preferably downstream of said superheater, along the outlet path of the hot combustion fumes of the heater.

In one aspect the auxiliary hydraulic circuit comprises a plurality of auxiliary pipes configured for traversing said auxiliary recuperator and for being connected with one or more auxiliary uses, preferably space heating utilities and/or sanitary hot water production units.

In one aspect the auxiliary hydraulic circuit comprises an auxiliary pump, placed in said auxiliary hydraulic circuit and operatively active on a pipe of said plurality of auxiliary pipes for determining a circulation in said auxiliary circuit.

In one aspect said auxiliary recuperator is configured for recovering energy from the combustion fumes and for transmitting it to the fluid circulating in said auxiliary circuit, said energy then being available for said auxiliary uses.

In one aspect the heat engine comprises a fan placed at said inlet of comburent air of said containment body of the heater and configured for drawing comburent air from the environment and forcibly sending it to said burner in order to feed the combustion process.

In one aspect the heat engine comprises one or more check valves placed along the pipes of the drive circuit of the heat engine and configured for facilitating the circulation of the thermal fluid in a unidirectional manner and preventing the flow of the thermal fluid in opposite direction.

In one aspect, said energy transformation members are configured for transforming the energy of said thermal fluid into mechanical energy according to an operative cycle which provides for a sequence of steps of:

suctioning thermal fluid into said at least one operative chamber;

compressing the thermal fluid in said at least one operative chamber and pouring the thermal fluid;

loading thermal fluid into said at least one operative chamber and expanding the thermal fluid in said at least one operative chamber;

discharging thermal fluid from said at least one operative chamber.

In one aspect said energy transformation members comprise one or more, preferably a plurality of, blades or pistons or equivalent members.

In one aspect, said drive unit is a two-stroke engine or a four-stroke engine, or a reciprocating engine, or a rotary engine.

In one aspect said drive unit is a heat engine comprising a compressor, performing said suction and compression steps, and an expander, performing said expansion and discharge steps.

In one aspect said compressor and said expander are mechanically independent from each other or connected by means of transmission members.

In one aspect said compressor is a multistage rotary compressor and said expander is a turbine expander.

In one aspect, said at least one operative chamber comprises:

a first chamber, provided with said first inlet and with said first outlet, in which the suction of the thermal fluid and the compressing of the thermal fluid occur;

a second chamber, separate from said first chamber, provided with said second inlet and with said second outlet, in which the loading of the compressed thermal fluid, the expanding of the thermal fluid and the discharge of the thermal fluid occur.

In one aspect said drive unit is a drive unit with intermittent flow, in which:

said first chamber is an operative chamber with variable volume, configured for operating a fluid suction and a fluid compression;

said second chamber is an operative chamber with variable volume, configured for operating a fluid expansion and a fluid discharge.

In one aspect (alternative to the preceding) said drive unit is a drive unit with continuous flow, in which:

said first chamber is structured for attaining a compressor, configured for operating a fluid suction and a fluid compression;

said second chamber is structured for attaining a turbine, configured for operating a fluid expansion and a fluid discharge.

In one aspect, said first inlet and said second inlet coincide and in which said first outlet and said second outlet coincide.

In one aspect the heat engine comprises an electric generator, e.g. an alternator, connected with said output shaft in a manner such to receive said rotary motion preferably at constant angular speed and generate electric current intended to power supply an external utility.

In one aspect, said thermal fluid is a mixture comprising a gas and water vapor or water, in which said gas is preferably air and/or helium and/or other gaseous fluid compatible with the water vapor or the water, and said thermal cycle attained by the heat engine is a combined thermal cycle.

In an independent aspect thereof, the present invention regards a method for attaining a thermal cycle, the method operating with a thermal fluid and comprising the steps of:

arranging a heat engine, preferably according to one or more of the above aspects;

executing the following steps:

starting said drive unit, moving said members for transforming the energy of said thermal fluid;

activating said heater for heating the thermal fluid in said drive circuit;

activating an operative cycle comprising the steps of:

suctioning said thermal fluid in said at least one operative chamber through said first inlet;

compressing said thermal fluid in said at least one operative chamber and pouring said thermal fluid from said first outlet;

heating the thermal fluid circulating in said second branch of the drive circuit by means of said heater;

loading said thermal fluid in said at least one operative chamber through said second inlet and expanding said thermal fluid in said at least one operative chamber;

discharging said thermal fluid from said at least one operative chamber through said second outlet;

in which said steps of the operative cycle of suctioning, compressing, loading and discharging the thermal fluid determine a transformation of the energy of said thermal fluid into mechanical energy.

In one aspect the method comprises the step of transferring said mechanical energy generated by said transformation members to said output shaft, which provides a rotary motion at the outlet, preferably with constant angular speed.

In one aspect the method comprises the following steps:

the thermal fluid exiting from said second outlet of the drive unit moves into the second outlet duct of the first branch of the drive circuit and traverses the high-temperature side of the vaporizer;

the thermal fluid continues into the first branch and reaches the condenser where it is cooled;

the thermal fluid continues into the first branch and reaches the condensation separator where the water present in the thermal fluid is condensed and separated from the air, before the thermal fluid reaches said first inlet of the drive unit;

the condensation water previously extracted from the air by means of the condensation separator is drawn and sent, by means of the pump at high pressure, in a vaporization pipe flowing into said second branch, at a point of said first outlet duct upstream of the heater;

the condensation water circulating in the vaporization pipe traverses the low-temperature side of the vaporizer, where it is heated and vaporized before it flows into said second branch;

a predefined quantity of water vapor is injected into the second branch, upstream of the heater, by means of the injector, said water vapor quantity being capable of increasing the unit power of the drive unit and of ensuring the lubrication of said energy transformation members movably housed in said at least one operative chamber.

In one aspect the method comprises the following steps:

the condensation water, after having traversed the low-temperature side of the vaporizer, where it is heated and vaporized, continues into the vaporization pipe and reaches the superheater, placed upstream of the injector, which transfers heat to the condensation water vaporized in a manner such to overheat it before it reaches the injector.

In one aspect the method comprises the following steps:

arranging a cooling circuit, comprising the first recuperator, the cooling unit, the plurality of cooling pipes and the cooling pump;

executing the steps of:

the low-temperature cooling fluid interacts with the cooling unit, where it draws heat from the case of the drive unit, cooling it, and consequently it is brought to high temperature;

the high-temperature cooling fluid interacts with the first heat recuperator, where it transfers heat to the comburent air flow, heating it, and consequently it is cooled and returns to low temperature;

activating the cooling pump for determining the circulation of cooling fluid in the cooling circuit.

In one aspect the method comprises the following steps:

arranging the second recuperator in the cooling circuit;

executing the steps of:

in the cooling unit, the low-temperature cooling fluid draws heat from the case of the drive unit, cooling it, and consequently it is brought to high temperature;

in the second heat recuperator, the high-temperature cooling fluid acquires heat from the hot combustion fumes, cooling them, and consequently undergoes a temperature increase;

in the first heat recuperator, the high-temperature cooling fluid transfers heat to the comburent air flow, heating it, and consequently it is cooled and returns to low temperature.

In one aspect the method comprises the following steps:

arranging said auxiliary hydraulic circuit, comprising the auxiliary recuperator, the plurality of auxiliary pipes and the auxiliary pump;

executing the steps of:

recovering a quantity of energy from the combustion fumes, by means of said auxiliary recuperator;

transmitting said energy to the fluid circulating in said auxiliary circuit;

making said energy available for auxiliary uses.

In one aspect relative to the method for attaining a thermal cycle, said thermal fluid is a mixture comprising a gas and water vapor or water, in which said gas is preferably air and/or helium and/or other gaseous fluid compatible with the water vapor or the water, and in which said thermal cycle attained by the method is a combined thermal cycle.

Each of the aforesaid aspects of the invention can be taken separately or in combination with any one of the claims or of the other described aspects.

Further characteristics and advantages will be clearer from the detailed description of several embodiments, also including a preferred embodiment, which are non-exclusive examples of a heat engine in accordance with the present invention.

BRIEF DESCRIPTION OF THE DRAWINGS

Such description will be set forth hereinbelow with reference to the enclosed diagrams and drawings, provided only as a non-limiting example, in which.

DETAILED DESCRIPTION OF EMBODIMENTS

Figure 1:
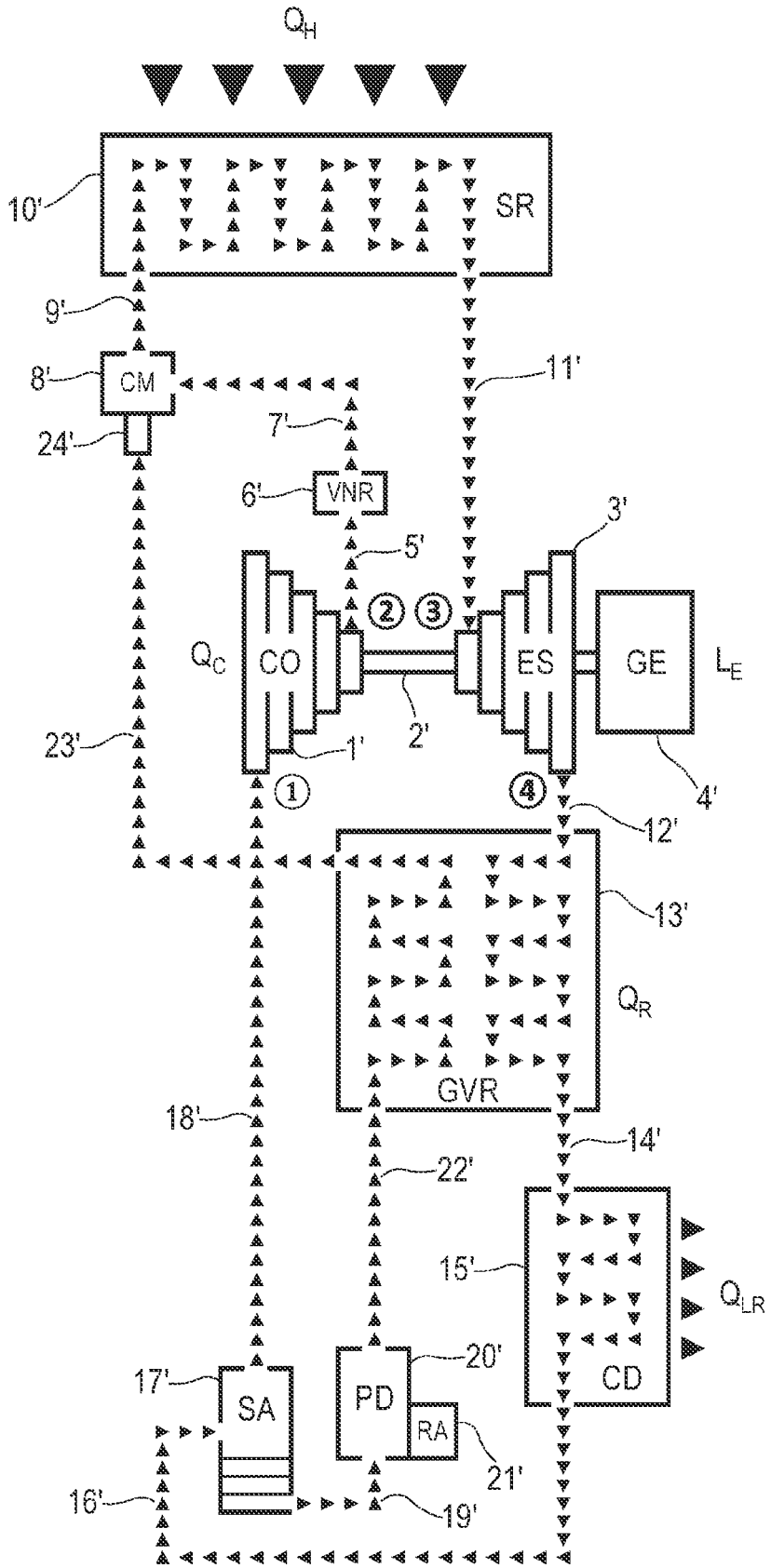
FIG. 1 represents an overal functional diagram of the "new combined SEOL cycle", object of the present invention in one of its aspects, with all the identifications necessary for its immediate and easy technical comprehension.
Figure 2:
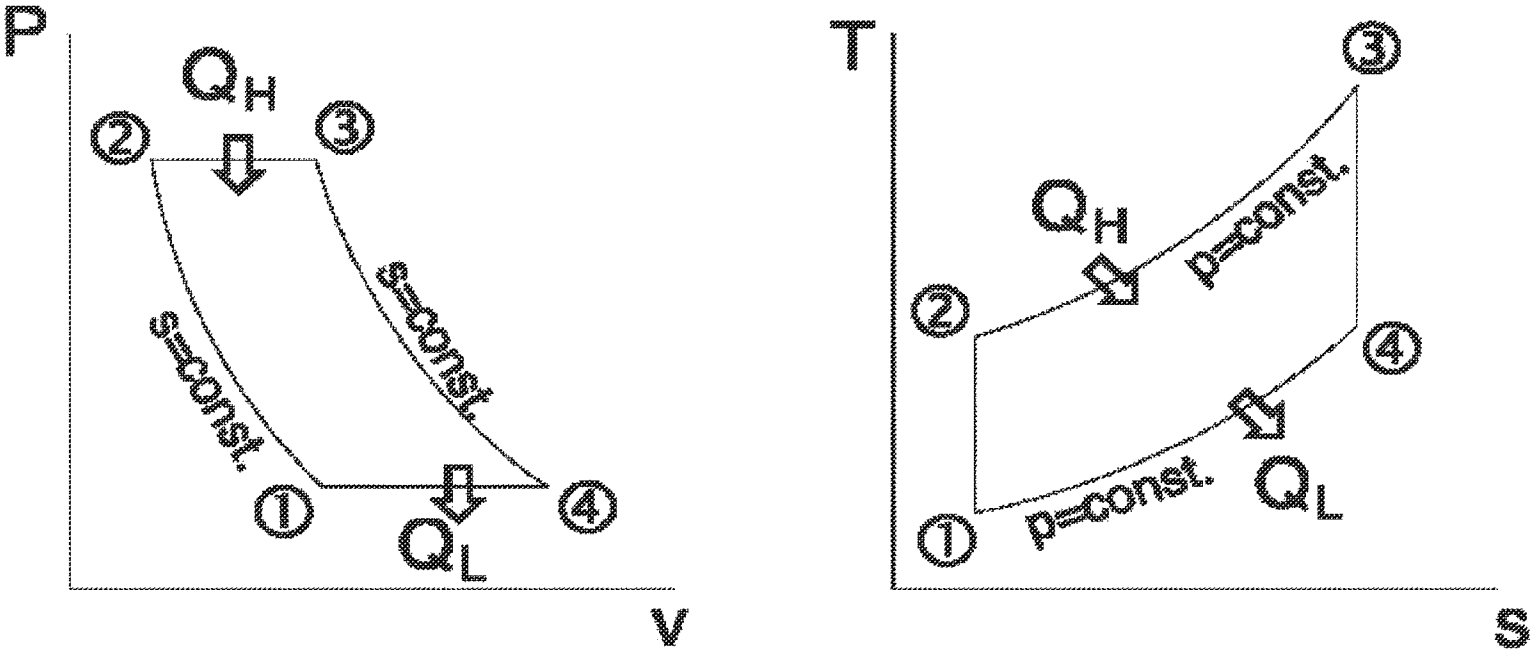
FIG. 2 reports the diagrams of the already technically know Joule cycle, only used as an aid for the deception.

One can observe the presence, in the detailed description and in FIGS. 3-9, of different possible embodiments of the heat engine in accordance with the present invention; for example, the structure of the heat engine can be in accordance with:

- a first functional configuration (see FIGS. 3, 4 and 5), with closed operative cycle, in which the thermal fluid is integrated with an injection of condensation water, having as primary object the lubrication of the operative chamber and of the energy transformation members and an increase of the unit power of the drive unit;
- a second functional configuration (see in particular FIG. 6), in which the thermal fluid is integrated with injection of overheated water vapor, which in addition to the lubrication of the operative chamber and of the energy transformation members and to the considerable increase of the unit power of the drive unit, also allows considerable improvement of the overall yield of the thermal cycle;
- a third functional configuration (see the embodiments of FIGS. 7, 8 and 9), in which the thermal fluid is integrated with injection of overheated water vapor which, in addition to the lubrication and to the increase of the unit power of the drive unit, allows a considerable improvement of the overall yield of the thermal cycle, and also (in accordance with different embodiments) the thermal/energy recovery of the circulation fluids is provided (as will be clear hereinbelow).

The heat engine of the present invention can also be implemented in accordance with a combination of the embodiments shown in FIGS. 3-9.

With reference to the abovementioned FIGS. 3-9, with the reference number 200 a heat engine in accordance with the present invention was indicated, in one of its aspects. In general, the same reference number is used for equivalent or similar elements, possibly in their embodiment variants.

The heat engine 200 is first of all configured for attaining a thermal cycle, operating with a thermal fluid, and comprises a drive unit 1 and a drive circuit 10.

The drive unit 1 comprises a case 2, which delimits at least one operative chamber 3 at its interior, and members for transforming the energy of the thermal fluid, movably housed within the operative chamber 3 and configured for transforming the thermal energy of the thermal fluid into mechanical energy, according to an operative cycle, which will be illustrated in more detail hereinbelow.

The drive unit comprises an output shaft 8 operatively connected to the energy transformation members and configured for receiving the aforesaid mechanical energy and providing a rotary motion at the outlet, preferably with constant angular speed, usable by a device downstream of the drive unit (e.g. an electric generator).

The case 2, delimiting the operative chamber 3 at its interior, has:

- a first inlet 4 in fluid communication with a first inlet duct 14 in order to receive therefrom a flow of thermal fluid being suctioned into the at least one operative chamber 3;
- a first outlet 5 in fluid communication with a first outlet duct 15 in order to send thereto a flow of thermal fluid under compression exiting from the at least one operative chamber 3;
- a second inlet 6 in fluid communication with a second inlet duct 16 in order to receive therefrom a flow of thermal fluid being loaded to be expanded in the at least one operative chamber 3;
- a second outlet 7 in fluid communication with a second outlet duct 17 in order to send thereto a flow of thermal fluid being discharged exiting from the at least one operative chamber 3.

Figure 3:
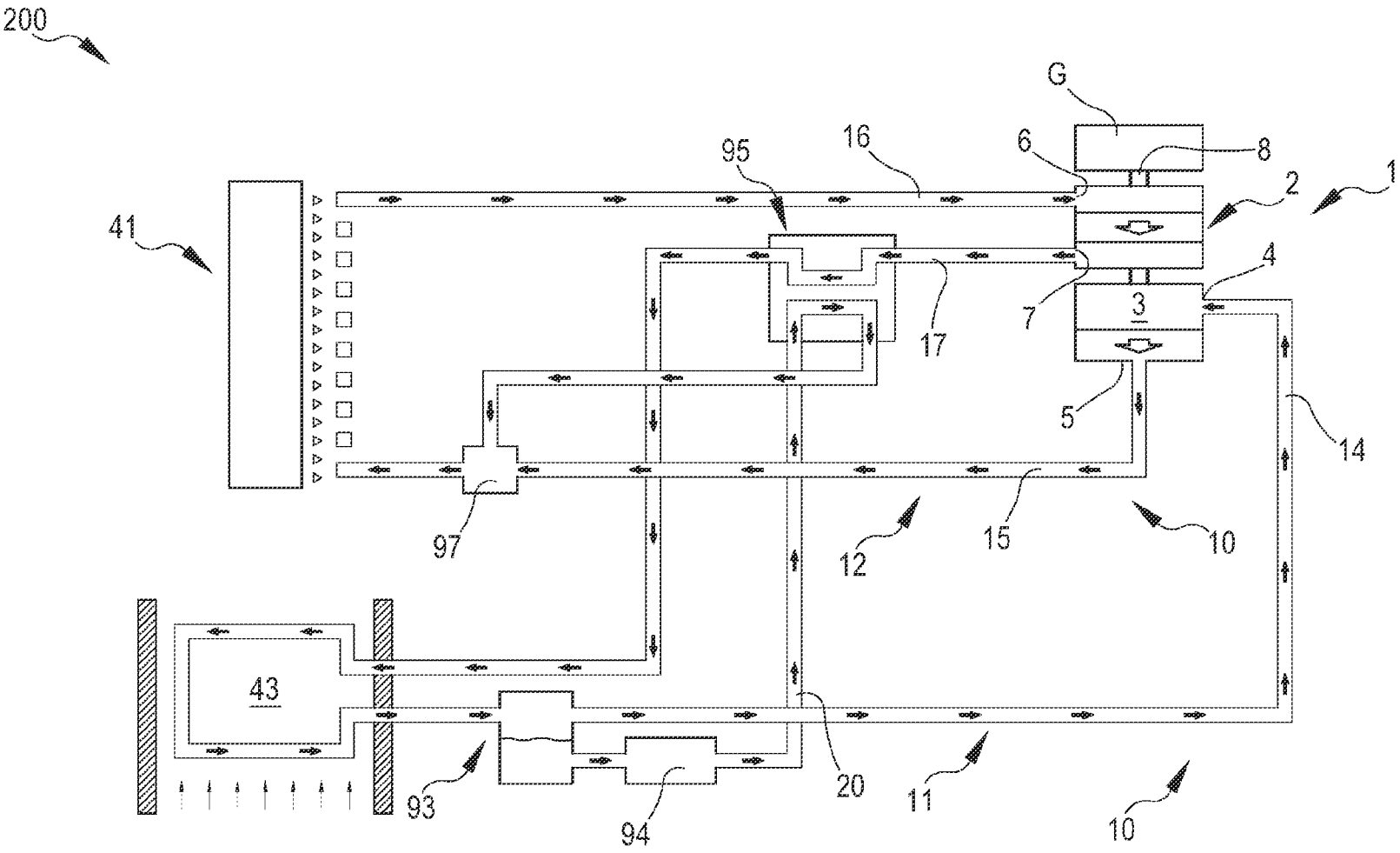
FIG. 3 schematically illustrate a first possible embodiment of a heat engine according to the present invention.
Figure 3A:
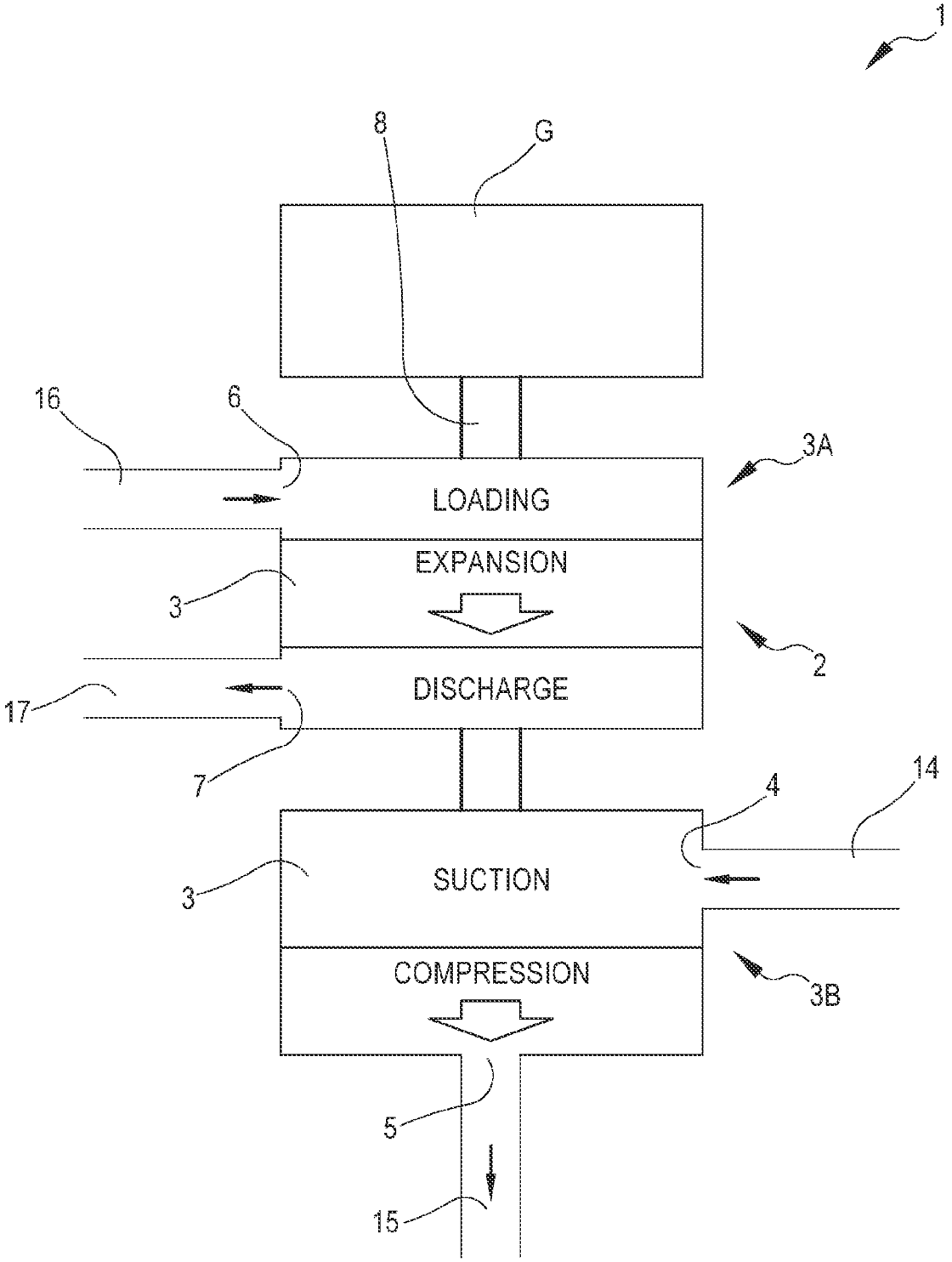
FIG. 3A shows an enlargement of a portion of the heat engine of FIG. 3, and in particular it illustrates the drive unit.

The inlets, the outlets, the inlet ducts, the outlet ducts and the operations completed on the fluid in the operative chamber (i.e. suction, compression, loading/expansion and discharge) are schematically illustrated in FIGS. 3-9, and in particular in FIG. 3A.

The aforesaid drive circuit 10 is extended between the first inlet 4, the second inlet 6, the first outlet 5 and the second outlet 7 and comprises the aforesaid first inlet duct 14, first outlet duct 15, second inlet duct 16 and second outlet duct 17.

Preferably the drive circuit 10 attains a continuous cycle of thermal fluid flow through the aforesaid at least one operative chamber 3 of the drive unit, in which:

- the second outlet duct 17 starts from the second outlet 7 of the case 2 of the drive unit and terminates by being continuously connected with the first inlet duct 14, the latter terminating in the first inlet 4 of the case 2 of the drive unit, the second outlet duct and the first inlet duct attaining a first closed branch 11 of the drive circuit;
- the first outlet duct 15 starts from the first outlet 5 of the case 2 of the drive unit and terminates by being continuously connected with the second inlet duct 16, the latter terminating in the second inlet 6 of the case 2 of the drive unit, the first outlet duct and the second inlet duct attaining a second closed branch 12 of the drive circuit.

In substance the first branch is formed by the joining in series of the second outlet duct 17 and the first inlet duct 14, while the second branch is formed by the joining in series of the first outlet duct 15 and the second inlet duct 16. In the first branch, there is continuity (structural and fluid) between the second outlet duct 17 and the first inlet duct 14, while in the second branch there is continuity (structural and fluid) between the first outlet duct 15 and the second inlet duct 16.

Preferably the heat engine comprises a heater 41 that is operatively active, along the second closed branch 12 of the drive circuit 10, between the first outlet duct 15 and the second inlet duct 16, and configured for heating the thermal fluid circulating in the second branch.

It is observed that, in the second branch 12, the heater 41 is structurally and operatively interposed between, and divides, the first outlet duct 15 and the second inlet duct 16.

Preferably the heat engine 200 comprises a condenser 43 that is operatively interposed along the first closed branch 11 of the drive circuit 10, between the second outlet duct 17 and the first inlet duct 14, and configured for cooling the thermal fluid circulating in the first branch 11.

It is observed that, in the first branch 11, the condenser 43 is structurally and operatively interposed between, and divides, the second outlet duct 17 and the first inlet duct 14.

Preferably the heat engine 200 comprises a condensation separator 93, placed downstream of the condenser 43 along the first inlet duct 14, where the water present in the thermal fluid is condensed and separated from the air, before the thermal fluid reaches the first inlet 4 of suction into the operative chamber 3. The condensation separator 93 then allows separating the gaseous part of the mixture (air and/or helium and/or another compatible gas) from the liquid part (condensation water), so as to render them separately usable in the cycle. Preferably the heat engine comprises a pump 94 (preferably at high pressure), configured for drawing the condensation water previously extracted from the air by means of the condensation separator 93 and for sending it into a vaporization pipe 20 flowing into the second branch 12, at a point of the first outlet duct 15 upstream of the heater 41.

Preferably, as shown in FIGS. 3-9, the heat engine comprises a vaporizer 95, situated in a position such to:

- intercept, on a high-temperature side thereof (o first side), the second outlet duct 17 downstream of the drive unit 1 and upstream of the condenser 43; and
- intercept, on a low-temperature side thereof (or second side), the vaporization pipe 20.

Preferably the vaporizer 95 is configured for heating and vaporizing the condensation water circulating in the vaporization pipe 20 before it flows into the second branch 12.

In substance, the vaporizer 95 (which constitutes a water vapor generator) is capable of removing (in its high-temperature side) most of the residual thermal energy contained in the thermal fluid discharged from the second outlet 7 after the expansion and transferring it (in its low-temperature side) to the condensation water carried by the vaporization pipe, thus using such thermal energy for generating overheated water vapor to be reintroduced in the drive circuit.

Preferably the heat engine comprises an injector 97, placed at the end of the vaporization pipe 20 and configured for injecting into the second branch 12, upstream of the heater 41, a predefined quantity of water vapor, capable of increasing the unit power of the drive unit 1 and of ensuring the lubrication of said energy transformation members movably housed in the operative chamber 3.

Preferably the vaporizer 95 is operatively interposed, on the low-temperature side thereof, between the pump 94 and the injector 97, and is operatively interposed, on the high-temperature side thereof, between the second outlet 7 of the drive unit 1, which expels spent thermal fluid, and the condenser 43, in a manner such that the vaporizer acquires residual energy-heat from the spent thermal fluid and uses it for preheating the thermal fluid moving towards the heater 41.

Preferably the vaporizer is a heat exchanger, provided with two sides which intercept—respectively—the second outlet duct 17 (downstream of the drive unit 1 and upstream of the condenser 43) and the vaporization pipe 20, in a manner such to transfer heat from the thermal fluid circulating in the second outlet duct 17 (cooling it) to the fluid circulating in the vaporization pipe 20 (heating it and vaporizing it).

It is observed that the function performed by the vaporizer 95 is that of allowing the recovery of the energy differential between the temperature of the thermal fluid at the end of expansion (discharged from the second outlet 7 of the operative chamber) and the temperature of the same at nearly complete condensation (measured at the outlet of the vaporizer on the second outlet duct 17), i.e. a very high differential (e.g. from a temperature of 360° C. to a temperature of 40° C.). By using such energy differential, the vaporizer is capable of producing overheated water vapor, entirely reusable in the drive circuit.

It is observed that the injector 97 is the point at which the vaporization duct 20 flows into the second branch 12 of the drive circuit 10. The injector 97 acts as a "mixing box" which receives the thermal fluid (following the compression) exiting from the first outlet 5 and carried by the duct 15 (hence coming from the compression part of the operative chamber 3), and mixes it with the overheated water vapor transported by the vaporization duct 20 after the transit in the vaporizer 95.

Figure 4:
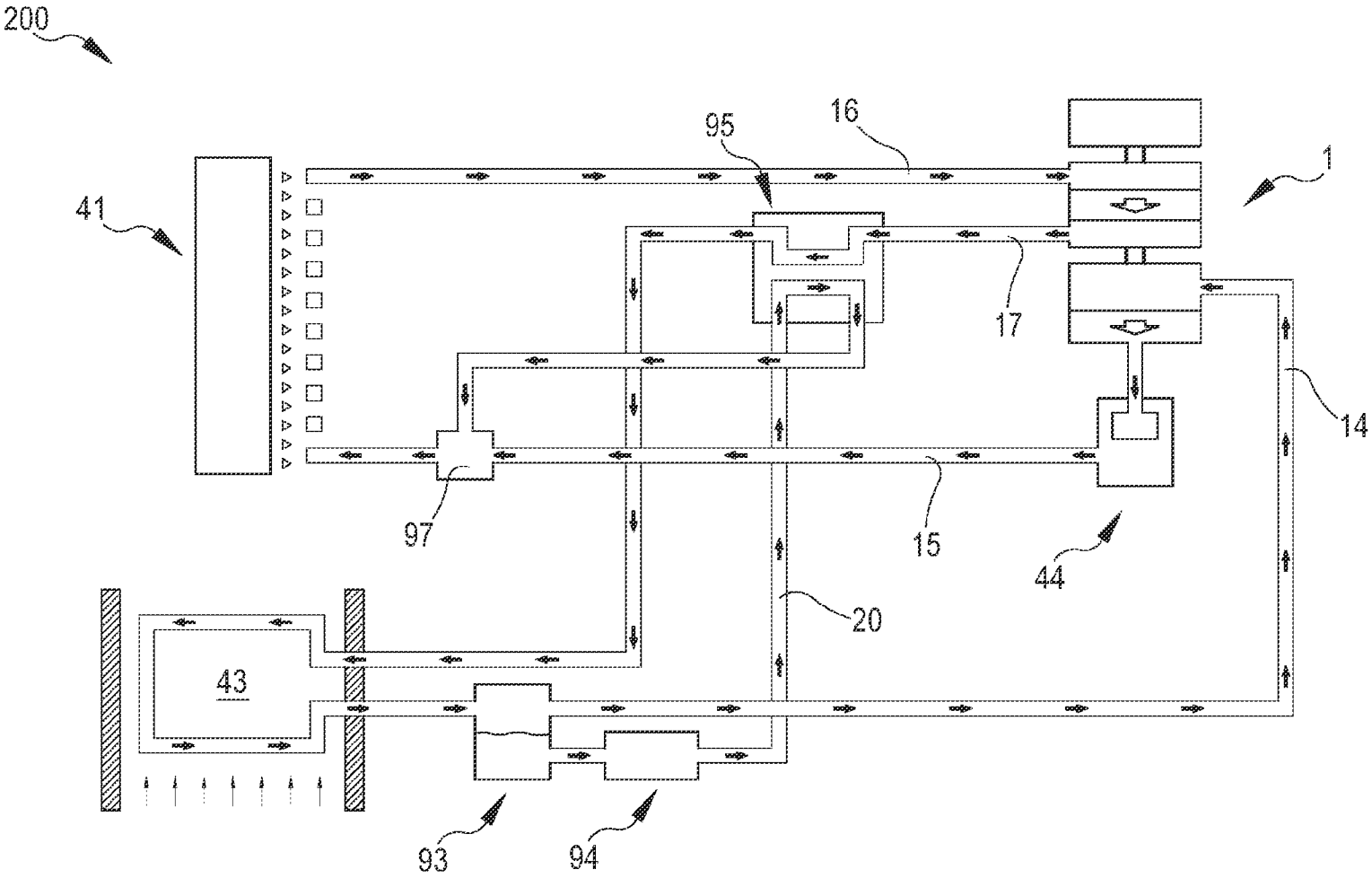
FIG. 4 shows the heat engine of FIG. 3, with several additional components.
Figure 5:
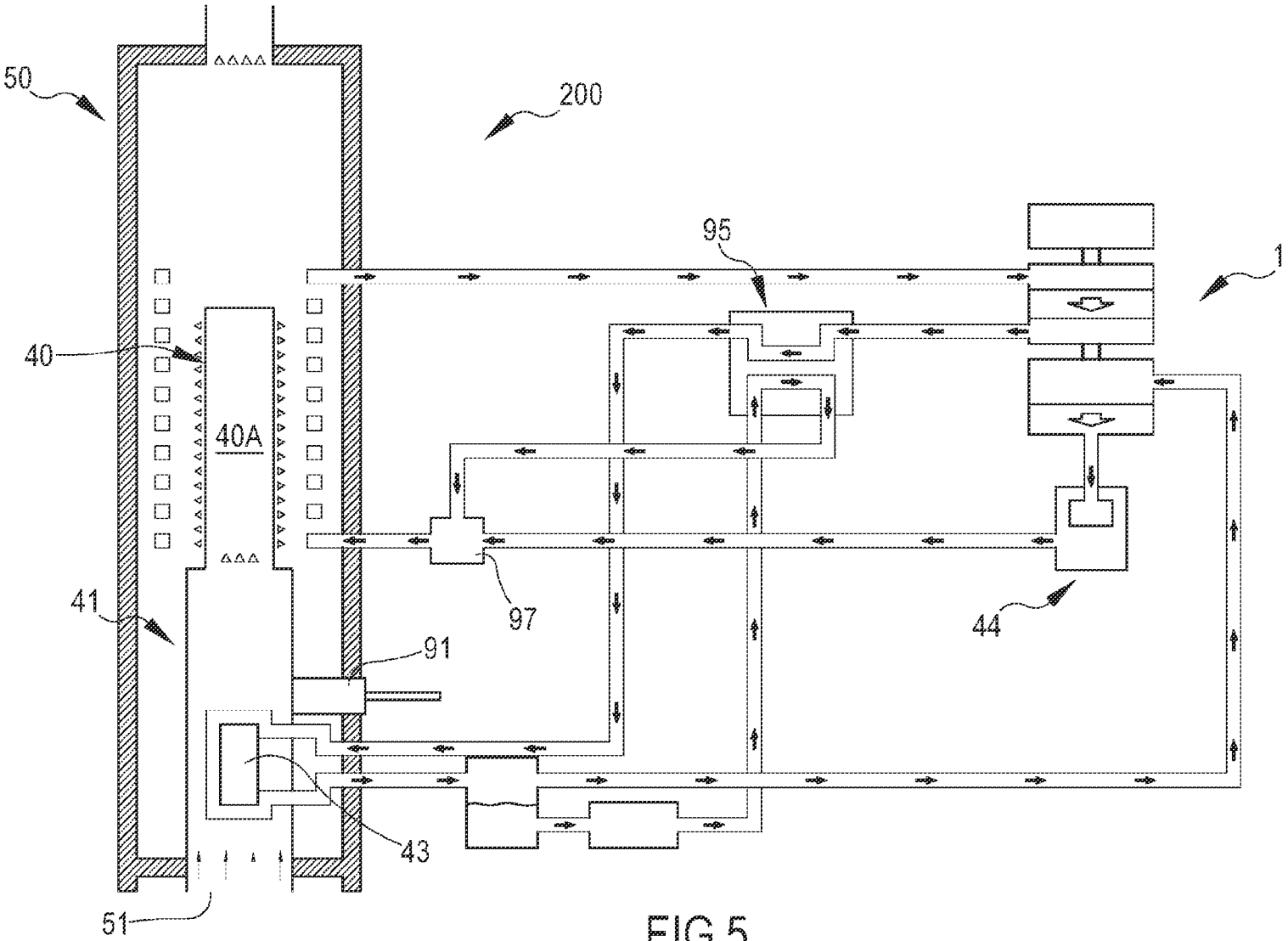
FIG. 5 shows the heat engine of FIG. 4, with several additional components.

Preferably, as shown for example in FIG. 4, the heat engine comprises a compensation tank 44 positioned downstream of the first outlet 5 of the drive unit along the first outlet duct 15 and configured for storing the compressed thermal fluid in order to make it available for the subsequent use thereof, in order to balance and optimize the thermal fluid flow circulating in the drive circuit 10.

Preferably (see FIGS. 5-9) the heater comprises a burner 40 with enclosed combustion chamber 40A, configured for being fed with a plurality of fuel types and for providing the heater 41 with the thermal energy necessary for the operation thereof.

Preferably the heater 41 comprises an injection valve 91 configured for managing the introduction of fuel in order to feed the burner in a controlled manner.

Preferably, the heater 41 can comprise a containment body 50 provided with an inlet for comburent air 51, typically drawn from the environment, and housing both the burner 40, operatively active along the second closed branch of the drive circuit, and the condenser 43, operatively active along the first closed branch (11) of the drive circuit, in a manner such that the heat drawn from the first branch by means of the condenser is transferred to the comburent air before this reaches the burner 40, facilitating the process of combustion and heating of the thermal fluid in the second branch 12.

Preferably (see the embodiment of FIG. 6) the heat engine 200 comprises a superheater 96 positioned downstream of the burner 40 in order to remove energy from the hot combustion fumes of the burner, and configured for intercepting the vaporization pipe 20 in a position downstream of the low-temperature side of the vaporizer 95 and upstream of the injector 97.

Preferably the superheater 96 is configured for transferring the energy removed from the hot combustion fumes of the burner to the condensation water vaporized at the outlet from the vaporizer 95, in a manner such to overheat it before it reaches the injector.

Preferably (see the embodiment of FIG. 7) the heat engine 200 is provided with a closed cooling circuit 60, separate from the drive circuit.

Preferably the cooling circuit 60 comprises a first heat recuperator 98, preferably situated in the containment body 50 of the heater 41 in a position downstream of the condenser 43 and upstream of the burner 40, with respect to the direction of the comburent air flow in the heater.

Preferably the cooling circuit comprises a cooling unit 2R operatively associated with the case of the drive unit 1. As an example, the cooling unit can be an interspace externally associated with the case of the drive unit, e.g. in contact with at least one portion of the case.

Preferably the cooling circuit 60 comprises a plurality of cooling pipes connecting in series, to form a circular path, the first heat recuperator 98 and the cooling unit 2R, such cooling pipes carrying a quantity of cooling fluid (preferably water).

Preferably the cooling pipes are arranged in the heat engine in a manner such to:

- interact with the cooling unit 2R, where the low-temperature cooling fluid draws heat from the case of the drive unit, cooling it, and consequently it is brought to high temperature, and
- interact with the first heat recuperator 98, where the high-temperature cooling fluid transfers heat to the comburent air flow, heating it, and consequently returns to low temperature.

Preferably the cooling circuit 60 comprises a cooling pump 99, placed in the cooling circuit and operatively active on a pipe of said plurality of cooling pipes in order to determine a circulation of the cooling fluid in the cooling circuit.

Preferably (see the embodiment of FIG. 8) the cooling circuit comprises a second heat recuperator 100, preferably situated in the containment body of the heater in a position downstream of the burner 40, and preferably downstream also of the superheater 96, along the outlet path of the hot combustion fumes of the heater.

Preferably the plurality of cooling pipes connects in series, in said circular path, the first heat recuperator 98, the cooling unit 2R and the second heat recuperator 100, the latter being interposed downstream of the cooling unit 2R and upstream of the first heat recuperator 98, along the travel direction of the cooling fluid, in a manner such that:

- in the cooling unit 2R, the low-temperature cooling fluid draws heat from the case of the drive unit, cooling it, and consequently it is brought to high temperature;
- in the second heat recuperator 100, the high-temperature cooling fluid acquires heat from the hot combustion fumes, cooling them, and consequently undergoes a temperature increase;
- in the first heat recuperator 98, the high-temperature cooling fluid transfers heat to the comburent air flow (before it enters into the burner 40), heating it, and consequently returns to low temperature.

In such configuration:

- the first recuperator 98 cools the cooling fluid by transferring heat/energy to the comburent air;
- the cooling unit 2R cools the drive unit 1 by means of transfer of heat/energy from the drive unit to the cooling fluid, which undergoes a temperature increase;
- the second recuperator 100 heats the cooling fluid, acquiring heat/energy from the hot combustion fumes.

Preferably (see the embodiment of FIG. 9) the heat engine 200 is provided with an auxiliary hydraulic circuit comprising an auxiliary recuperator 101, preferably situated in the containment body of the heater in a position downstream of the burner 40, and preferably downstream also of the superheater 96, along the outlet path of the hot combustion fumes of the heater.

Preferably the auxiliary hydraulic circuit comprises a plurality of auxiliary pipes configured for traversing the auxiliary recuperator 101 and for being connected with one or more auxiliary uses 103, preferably space heating utilities and/or sanitary hot water production units.

Preferably the auxiliary hydraulic circuit comprises an auxiliary pump 104, placed in the auxiliary hydraulic circuit and operatively active on one of said auxiliary pipes for determining a circulation in the auxiliary hydraulic circuit. Preferably the auxiliary recuperator 101 is configured for recovering energy from the combustion fumes and for transmitting it to the fluid circulating in the auxiliary hydraulic circuit, such energy then being available for auxiliary uses 103.

Preferably the heat engine 200 comprises a fan 92 placed at the inlet of comburent air of the containment body 50 of the heater and configured for drawing comburent air from the environment and forcibly sending it to the burner 40 in order to feed the combustion process.

Preferably the heat engine can comprise one or more check valves, e.g. of known type, placed along the pipes of the drive circuit of the heat engine and configured for facilitating the circulation of the thermal fluid in a unidirectional manner and preventing the flow of the thermal fluid in opposite direction.

Preferably, as schematically illustrated in FIG. 3A, the energy transformation members are configured for transforming the energy of the thermal fluid into mechanical energy according to an operative cycle which provides for a sequence of steps of:

- suctioning thermal fluid into the at least one operative chamber 3 (by means of the first inlet 4);
- compressing the thermal fluid in the at least one operative chamber and pouring (i.e. outward exit) of the thermal fluid (by means of the first outlet 5);
- loading thermal fluid into the at least one operative chamber 3 (by means of the second inlet 6) and expanding the thermal fluid in the operative chamber;
- discharging thermal fluid from the at least one operative chamber (by means of the second outlet 7).

Preferably the energy transformation members comprise one or more, preferably a plurality of, blades or pistons or equivalent members.

As an example, the drive unit can be a two-stroke engine or a four-stroke engine, or a reciprocating engine, or a rotary engine.

As an example the drive unit is a heat engine comprising a compressor, performing the steps of suction and compression, and an expander, performing the steps of expansion and discharge. The compressor and the expander can be mechanically independent from each other or connected by means of transmission members. As an example the compressor is a multistage rotary compressor and the expander is a turbine expander.

In possible embodiments, like those shown in FIGS. 3-9, preferably the aforesaid at least one operative chamber 3 comprises:

- a first chamber 3A, provided with the first inlet 4 and the first outlet 5, in which the suction of the thermal fluid and the compressing of the thermal fluid occur;
- a second chamber 3B, separate from the first chamber, provided with the second inlet 6 and the second outlet 7, in which the loading of the compressed thermal fluid, the expanding of the thermal fluid and the discharge of the thermal fluid occur.

In substance, the chamber 3 is divided into two sub-chambers, each of which intended to carry out a respective half of the operative cycle.

The drive unit 1 can be a drive unit with intermittent flow, in which:

- the first chamber 3A is an operative chamber with variable volume, configured for operating a fluid suction and a fluid compression;
- the second chamber 3B is an operative chamber with variable volume, configured for operating a fluid expansion and a fluid discharge.

Alternatively, the drive unit 1 is a drive unit with continuous flow, in which:

- the first chamber 3A is structured for attaining a compressor, configured for operating a fluid suction and a fluid compression;
- the second chamber 3B is structured for attaining a turbine, configured for operating a fluid expansion and a fluid discharge.

In a possible embodiment (not shown), with single operative chamber, the first and the second inlet coincide with each other, and the first and the second outlet coincide with each other.

At the state of the art, some known types of endothermic engines (with internal combustion), with suitable mechanical and functional modifications, can be adapted for use as drive unit 1. By way of a non-limiting example, the following engines are listed:

four-stroke Diesel reciprocating engine;

four-stroke Otto reciprocating engine;

four-stroke Wankel rotary engine;

four-stroke Quasiturbine rotary engine (patent US-2014-0140879-A1);

At the state of the art, some other types of exothermic engines (with external combustion), with suitable mechanical and functional modifications, can be adapted for use as drive unit 1. By way of a non-limiting example, the following engines are listed:

RVE rotary engine, formed by a Suction-Compression section and by one or two Expansion-Discharge sections, delimited by four or six slidable pistons, with periodically variable speed, within a single annular cylinder, as already described in the patent applications WO2015/114602A1 and WO2019/008457, in the name of the same Applicant;

Ericsson reciprocating engine with two cylinders;

Wankel rotary engine, formed by a compressor and by an expander, mechanically connected to each other by means of any one transmission system (patent: U.S. Pat. No. 3,426,525);

palette rotary engine, formed by a compressor and by an expander, mechanically connected to each other by means of any one transmission system (patent: DE4317690A1);

trefoil rotary engine; formed by a compressor and by an expander, mechanically connected to each other by means of any one transmission system (patent: US20110259002A1);

RVE rotary engine, formed by a compressor and by an expander, mechanically connected to each other by means of a suitable transmission system (patent: WO02084078A1);

Scroll rotary engine, formed by a compressor and by an expander, mechanically connected to each other by means of a suitable transmission system (patent: US20050172622A1);

rotary engine with multistage Turbine, formed by a compressor and by an expander, mechanically connected to each other by means of a suitable transmission system (patent: WO2012123500A2).

The heat engine 200 can comprise, preferably, an electric generator G, e.g. an alternator, connected with the output shaft 8 in a manner such to receive the rotary motion (generated by the drive unit 1) at the input, preferably at constant angular speed, and generate electric current at the output intended to power supply an external utility.

The electric generator G is configured for transforming the mechanical work produced by the drive unit (in particular by the expansion part) into electrical energy.

The electric generator can also be arranged for performing the function of starting motor in the initial step of starting the drive unit.

In the scope of the present invention, the aforesaid thermal fluid is a mixture comprising a gas and water vapor or water.

The aforesaid gas can be air or helium or any other gaseous fluid (or mixture of gaseous fluids) compatible with the water vapor or the water, and the thermal cycle attained by the heat engine is a combined thermal cycle.

It is also specified that in a "rest" condition of the heat engine, the employed fluids (e.g. air and water) are situated at the same temperature as the surrounding environment and that, during operation, within the drive unit and the drive circuit, there can be pressures different from the atmospheric pressure.

It is observed that the heat engine comprises suitable command and adjustment apparatuses (e.g. an electronic control unit that is suitably programmed), not shown and for example of known type. In addition, the heat engine preferably comprises starting means configured for managing the steps of initialization of the operative cycle and starting of the various components of the heat engine (starting of the drive unit, heater, circulation of the thermal fluid, etc.).

Hereinbelow, the method is described for attaining a thermal cycle in accordance the present invention. Such method operates with a thermal fluid and first of all comprises the following steps:

arranging a heat engine, preferably in accordance with the present invention, for example a heat engine 200 according to the embodiments shown in FIGS. 3-9;

starting the drive unit 1, moving the members for transforming the energy of the thermal fluid;

activating the heater 41 for heating the thermal fluid in the drive circuit;

activating an operative cycle.

Preferably, the operative cycle comprising the following steps:

suctioning the thermal fluid into the operative chamber 3 (preferably into the first sub-chamber 3A) through the first inlet 4;

compressing the thermal fluid in the operative chamber and pouring the thermal fluid from the first outlet 5;

heating the thermal fluid circulating in the second branch 12 of the drive circuit 10 by means of the heater 41;

loading the thermal fluid into the operative chamber 3 (preferably into the second sub-chamber 3B) through the second inlet 6 and expanding the thermal fluid in the operative chamber 3;

discharging the thermal fluid from the operative chamber through the second outlet 7;

The steps of the operative cycle of suctioning, compressing, loading and discharging the thermal fluid determine a transformation of the thermal energy of the thermal fluid into mechanical energy.

Preferably the method comprises the step of transferring the mechanical energy generated by the transformation members to the output shaft 8, which provides a rotary motion at the outlet, preferably with constant angular speed.

Preferably the method comprises the following steps (see FIGS. 3-5 and the paths of the thermal fluid indicated by the arrows in the pipes, which illustrate the operation of the cycle):

the thermal fluid exiting from the second outlet 7 of the drive unit 1 moves into the second outlet duct 17 of the first branch 11 of the drive circuit 10 and traverses the high-temperature side of the vaporizer 95;

the thermal fluid continues into the first branch 11 and reaches the condenser 43 where it is cooled;

the thermal fluid continues into the first branch 11 and reaches the condensation separator 93 where the water present in the thermal fluid is condensed and separated from the air, before the thermal fluid reaches the first inlet 4 of the drive unit;

the condensation water previously extracted from the air by means of the condensation separator 93 is drawn and sent, by means of the pump 94, into a vaporization pipe 20 flowing into the second branch 12, at a point of the first outlet duct 15 upstream of the heater 41;

the condensation water circulating in the vaporization pipe 20 traverses the low-temperature side of the vaporizer 95, where it is heated and vaporized before it flows into the second branch 12;

a predefined quantity of water vapor is injected into the second branch 12, upstream of the heater 41, by means of the injector 97, such water vapor quantity being capable of increasing the unit power of the drive unit 1 and of ensuring the lubrication of the energy transformation members movably housed in the operative chamber 3.

Figure 6:
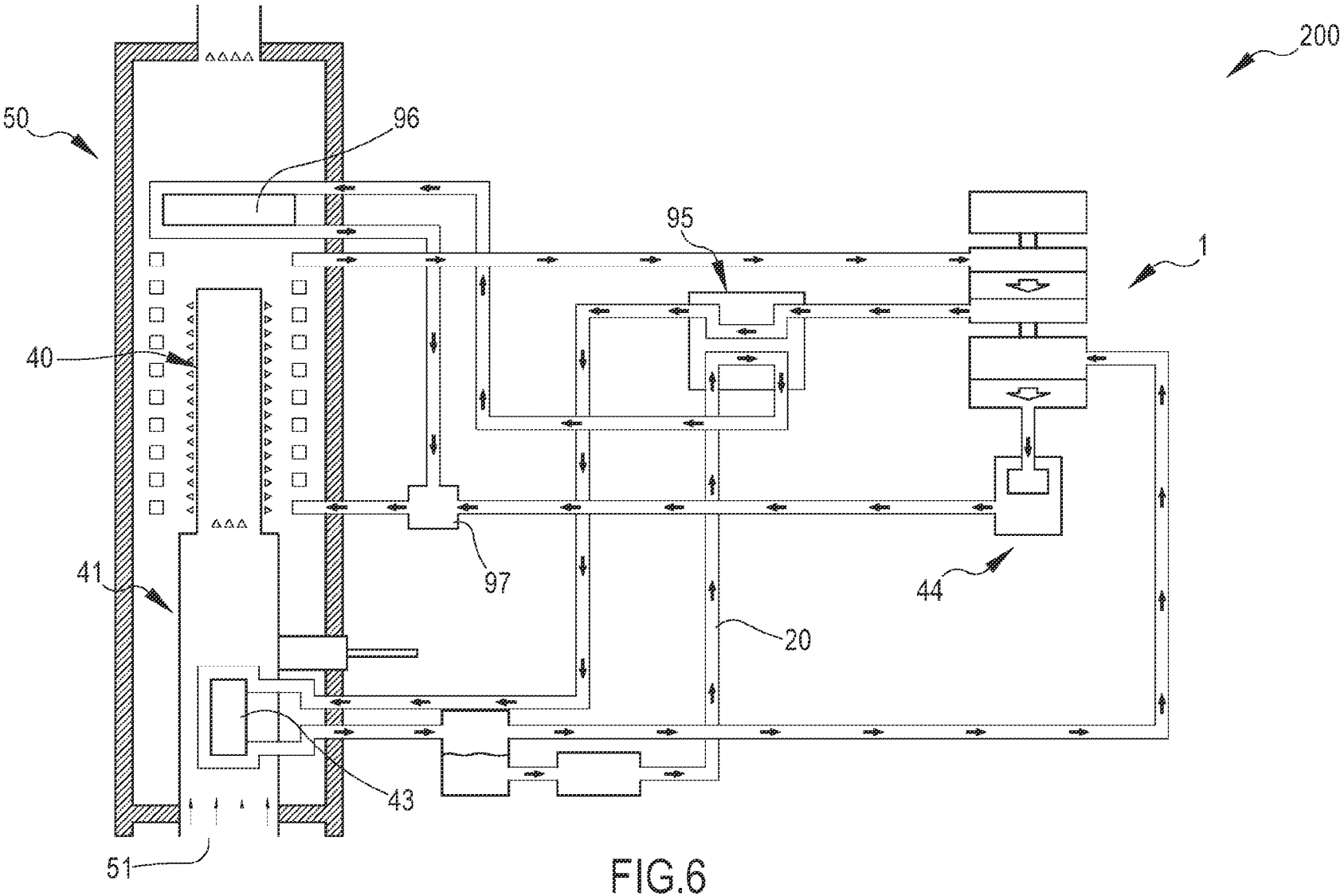
FIG. 6 schematically illustrates a further possible embodiment of a heat engine according to the present invention.

Preferably the method, in accordance with the embodiment of FIG. 6, comprises the following steps:

the condensation water, after having traversed the low-temperature side of the vaporizer 95, where it is heated and vaporized, continues into the vaporization pipe 20 and reaches the superheater 96, placed upstream of the injector 97 (i.e. between vaporizer 95 and injector 97), which transfers heat to the condensation water vaporized in a manner such to overheat it before it reaches the injector 97.

Figure 7:
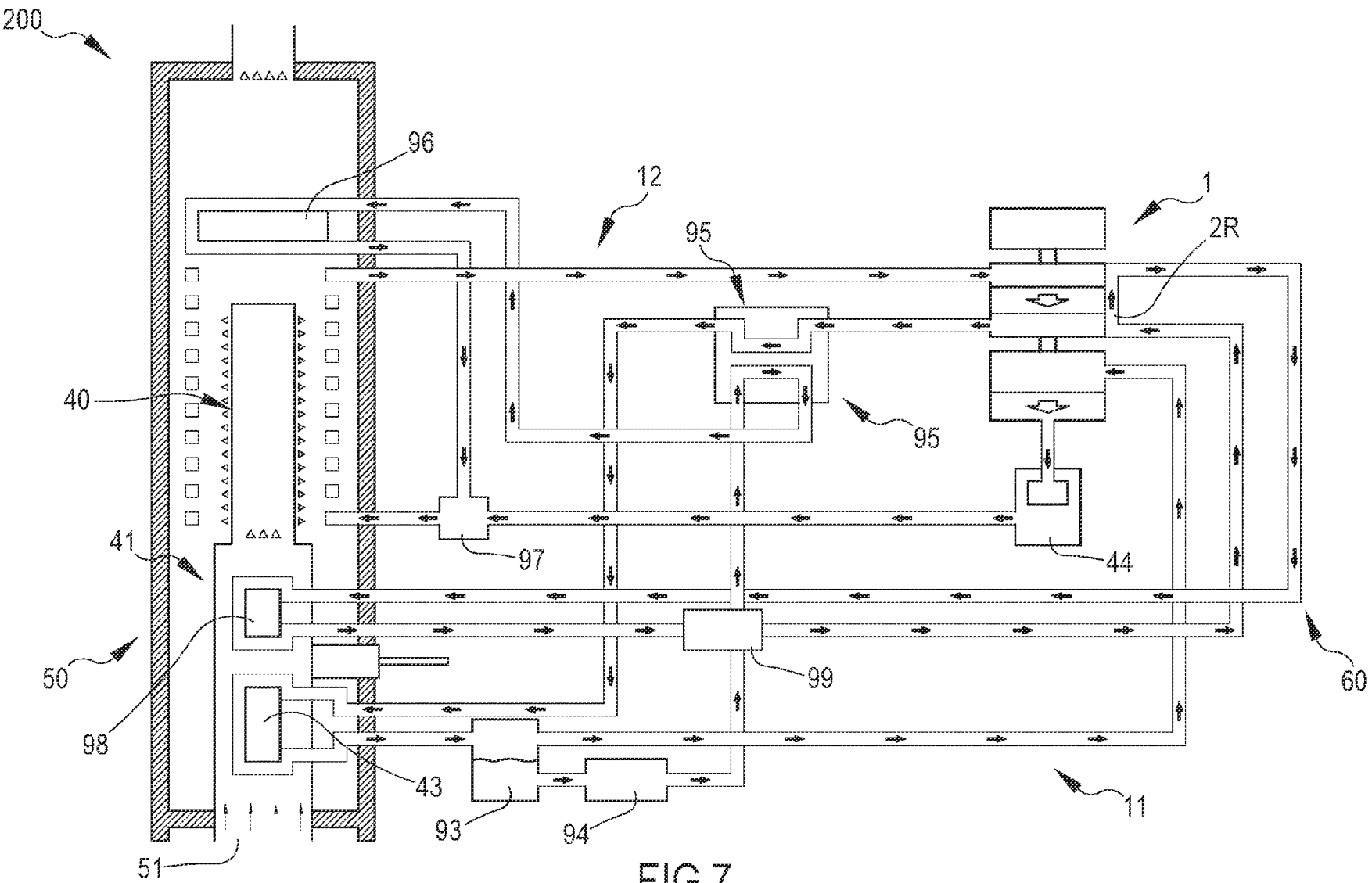
FIG. 7 schematically illustrates a further possible embodiment of a heat engine according to the present invention.

Preferably the method, in accordance with the embodiment of FIG. 7, can provide for arranging a cooling circuit 60, comprising the first recuperator 98, the cooling unit 2R, the plurality of cooling pipes and the cooling pump 99, and executing the following steps:

the low-temperature cooling fluid interacts with the cooling unit 2R, where it draws heat from the case 2 of the drive unit 1, cooling it, and consequently it is brought to high temperature;

the high-temperature cooling fluid interacts with the first heat recuperator 98, where it transfers heat to the comburent air flow, heating it, and consequently it is cooled and returns to low temperature;

activating the cooling pump 99 for determining the circulation of cooling fluid in the cooling circuit 60.

Figure 8:
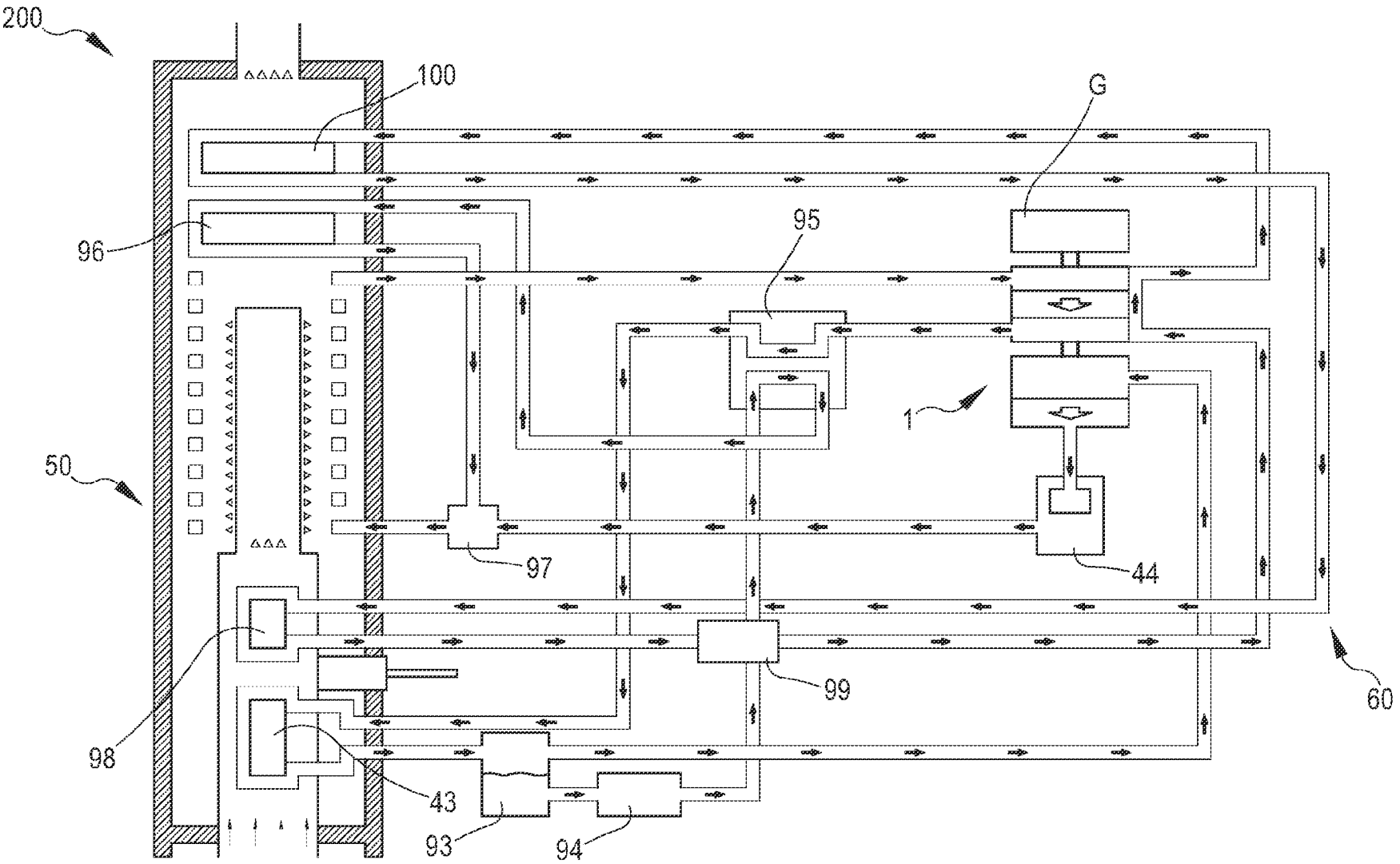
FIG. 8 schematically illustrates a further possible embodiment of a heat engine according to the present invention.

Preferably the method, in accordance with the embodiment of FIG. 8, can provide for arranging the second recuperator 100 within the cooling circuit 60, and for executing the following steps:

in the cooling unit 2R the low-temperature cooling fluid draws heat from the case 2 of the drive unit 1, cooling it, and consequently it is brought to high temperature;

in the second heat recuperator 100 the high-temperature cooling fluid acquires heat from the hot combustion fumes, cooling them, and consequently undergoes a further temperature increase;

in the first heat recuperator 98, the high-temperature cooling fluid transfers heat to the comburent air flow (before its entrance into the burner), heating it, and consequently it is cooled and returns to low temperature.

Figure 9:
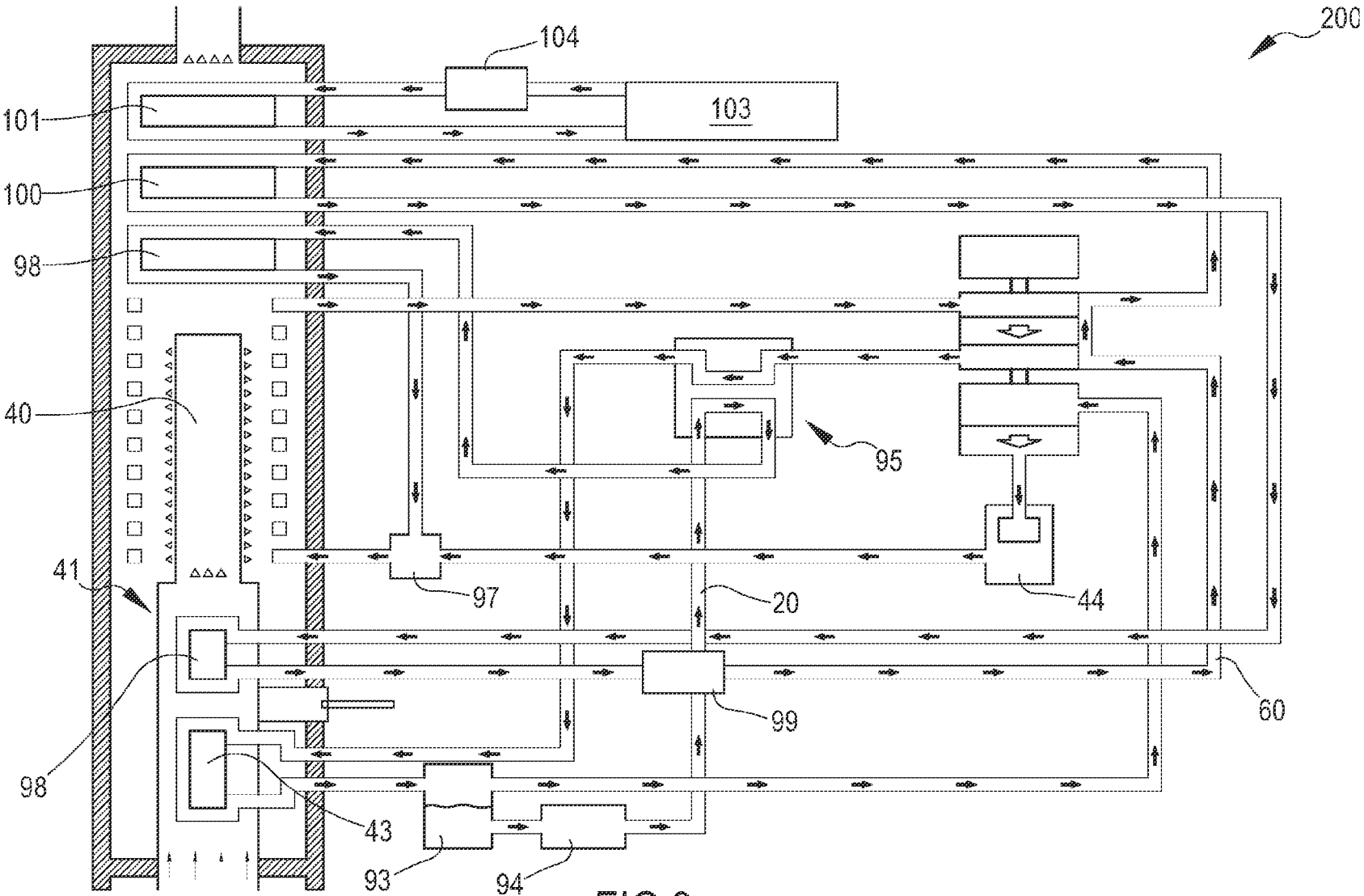
FIG. 9 schematically illustrates a further possible embodiment of a heat engine according to the present invention.

Preferably the method, in accordance with the embodiment of FIG. 9, can provide for arranging an auxiliary hydraulic circuit, comprising the auxiliary recuperator 101, the plurality of auxiliary pipes and the auxiliary pump 104, and for executing the following steps:

recovering a quantity of energy from the combustion fumes, by means of the auxiliary recuperator 101;

transmitting such energy to the fluid circulating in the auxiliary circuit;

making the energy available for auxiliary uses 103.

The invention thus conceived is susceptible of numerous modifications and variations, all falling within the scope of the inventive concept, and the abovementioned components can be substituted by other technically equivalent elements.

The invention attains important advantages. First of all, as clearly emerges from the above description, the invention allows overcoming at least some of the drawbacks of the prior art.

In addition, the heat engine and the relative method according to the present invention are capable of using multiple thermal sources and of generating mechanical energy (work), since they can be employed in any place and for any use, preferably for the production of electrical energy.

In addition, the heat engine according to the present invention is characterized by a high thermodynamic yield and by an optimal weight-power ratio.

From a thermodynamic standpoint, the injection of water vapor in the thermal fluid allows obtaining an optimal lubrication of the drive unit, with reduction of the friction and of the wear and consequent increase of the mechanical yield.

In addition, the thermal fluid allows obtaining an increase of the unit power, due to the increase of flow rate and molecular weight of the thermal fluid which is expanded in the drive unit. In addition, there is no increase of the negative compression work, since the water introduced in the thermal fluid is condensed and separated from the air (or from other gaseous fluid employed) before its suction.

In addition, the vaporizer allows obtaining an increase of the overall yield, since the quantity of heat absorbed by the evaporation is compensated for by the energy recovery actuated with the vaporizer.

In addition, the heat engine according to the present invention is characterized by a simple mechanical structure that is easy to attain.

In addition, the heat engine according to the present invention is characterized by a reduced production cost.

The invention claimed is:

1. Heat engine (200) configured for attaining a thermal cycle, the heat engine operating with a thermal fluid and comprising:

a drive unit (1) comprising:

a case (2) delimiting at least one operative chamber (3) at its interior and having:

a first inlet (4) in fluid communication with a first inlet duct (14) in order to receive therefrom a flow of said thermal fluid being suctioned into said at least one operative chamber (3);

a first outlet (5) in fluid communication with a first outlet duct (15) in order to send thereto a flow of said thermal fluid under compression exiting from said at least one operative chamber (3);

a second inlet (6) in fluid communication with a second inlet duct (16) in order to receive therefrom a flow of said thermal fluid being loaded, to be expanded in said at least one operative chamber (3); and a second outlet (7) in fluid communication with a second outlet duct (17) in order to send thereto a flow of said thermal fluid being discharged, exiting from said at least one operative chamber (3);

members for transforming the energy of said thermal fluid, movably housed within said at least one operative chamber (3) and configured for transforming the energy of said thermal fluid into mechanical energy, according to an operative cycle; and an output shaft (8) operatively connected to said energy transformation members and configured for receiving said mechanical energy and providing a rotary motion at the outlet, preferably at constant angular speed;

a drive circuit (10) extended between said first inlet (4) and second inlet (6) and said first outlet (5) and second outlet (7) and comprising said first inlet duct (14), said first outlet duct (15), said second inlet duct (16) and said second outlet duct (17), said drive circuit (10) attaining a continuous cycle of thermal fluid flow through said at least one operative chamber (3) of the drive unit, wherein:

said second outlet duct (17) starts from said second outlet (7) of the case (2) of the drive unit and terminates by being continuously connected with said first inlet duct (14), the latter terminating in said first inlet (4) of the case (2) of the drive unit, the second outlet duct and the first inlet duct attaining a first closed branch (11) of the drive circuit (10); and said first outlet duct (15) starts from said first outlet (5) of the case (2) of the drive unit and terminates by being continuously connected with said second inlet duct (16), the latter terminating in said second inlet (6) of the case (2) of the drive unit, the first outlet duct and the second inlet duct attaining a second closed branch (12) of the drive circuit (10); and a heater (41) that is operatively active, along said second closed branch (12) of the drive circuit (10), between said first outlet duct (15) and said second inlet duct (16), configured for heating the thermal fluid circulating in the second branch (12) of the drive circuit.

2. The heat engine (200) according to claim 1, comprising:

a condenser (43) that is operatively interposed along said first closed branch (11) of the drive circuit (10), between said second outlet duct (17) and said first inlet duct (14), configured for cooling the thermal fluid circulating in the first branch (11);

a condensation separator (93), placed downstream of the condenser (43) along said first inlet duct (14), where the water present in the thermal fluid is condensed and separated from the air, before the thermal fluid reaches said first inlet (4) for suctioning into said at least one operative chamber (3);

a pump (94), configured for drawing the condensation water previously extracted from the air by means of the condensation separator (93) and for sending it into a vaporization pipe (20) flowing into said second branch (12), at a point of said first outlet duct (15) upstream of said heater (41);

a vaporizer (95), situated in the heat engine in a manner such to intercept, on a high-temperature side thereof, said second outlet duct (17) downstream of the drive unit (1) and upstream of the condenser (43) and, on a low-temperature side thereof, said vaporization pipe (20), the vaporizer (95) being configured for heating and vaporizing the condensation water circulating in said vaporization pipe (20) before it flows into said second branch (12); and an injector (97), placed at the end of said vaporization pipe (20) and configured for injecting into the second branch (12), upstream of the heater (41), a predefined quantity of water vapor, capable of increasing the unit power of the drive unit (1) and of ensuring the lubrication of said energy transformation members movably housed in said at least one operative chamber (3).

3. The heat engine (200) according to claim 2, wherein the vaporizer (95) is operatively interposed, on the low-temperature side thereof, between said pump (94) and said injector (97), and is operatively interposed, on the high-temperature side thereof, between the second outlet (7) of the drive unit (2), which expels spent thermal fluid, and the condenser (43), in a manner such that the vaporizer acquires residual energy-heat from the spent thermal fluid and uses it for preheating the thermal fluid moving towards the heater (41).

4. The heat engine (200) according to claim 1, wherein the heater comprises a burner (40) with enclosed combustion chamber (40A), said burner being adapted to be power supplied with a plurality of fuel types and being configured for supplying the heater (41) with the thermal energy necessary for the operation thereof, and/or wherein said heater (41) comprises a containment body (50) provided with an inlet for comburent air (51), drawn from the environment, and housing both said burner (40), operatively active along said second closed branch of the drive circuit, and said condenser (43), operatively active along said first closed branch (11) of the drive circuit, in a manner such that the heat drawn from said first branch by means of the condenser is transferred to the comburent air before this reaches the burner (40), facilitating the process of combustion and heating of the thermal fluid in the second branch (12).

5. The heat engine (200) according to claim 1, further comprising a superheater (96) positioned downstream of said burner (40) in order to remove energy from the hot combustion fumes of the burner, and configured for intercepting said vaporization pipe (20) in a position downstream of said low-temperature side of the vaporizer (95) and upstream of said injector (97), said superheater (96) being configured for transferring the energy removed from the hot combustion fumes of the burner to the condensation water vaporized at the outlet from the vaporizer (95), in a manner such to overheat it before it reaches the injector (97).

6. The heat engine (200) according to claim 1, provided with a closed cooling circuit (60), separate from said drive circuit and comprising:

a first heat recuperator (98), situated in the containment body (50) of the heater (41) in a position downstream of the condenser (43) and upstream of the burner (40), with respect to the direction of the comburent air flow in the heater;

a cooling unit (interspace 2R) operatively associated with the case of the drive unit (1);

a plurality of cooling pipes connecting in series, to form a circular path, said first heat recuperator (98) and said cooling unit (2R), said cooling pipes carrying a quantity of cooling fluid (preferably water) and being arranged in the heat engine in a manner such to:

interact with said cooling unit (2R), where the low-temperature cooling fluid draws heat from the case of the drive unit, cooling it, and consequently it is brought to high temperature, and interact with said first heat recuperator (98), where the high-temperature cooling fluid transfers heat to the comburent air flow, heating it, and consequently returns to low temperature; and a cooling pump (99), placed in said cooling circuit and operatively active on a pipe of said plurality of cooling pipes for determining a circulation of said cooling fluid in the cooling circuit.

7. The heat engine (200) according to claim 6, wherein said cooling circuit comprises a second heat recuperator (100), situated in the containment body of the heater in a position downstream of the burner (40), and preferably downstream of said superheater (96), along the outlet path of the hot combustion fumes of the heater, and wherein said plurality of cooling pipes connects in series, in said circular path, said first heat recuperator (98), said cooling unit (2R) and said second heat recuperator (100), the latter being interposed downstream of the cooling unit (2R) and upstream of the first heat recuperator (98), along the travel direction of the cooling fluid, in a manner such that:

in said cooling unit (2R), the low-temperature cooling fluid draws heat from the case of the drive unit, cooling it, and consequently it is brought to high temperature;

in said second heat recuperator (100), the high-temperature cooling fluid acquires heat from the hot combustion fumes, cooling them, and consequently undergoes a temperature increase; and in said first heat recuperator (98), the high-temperature cooling fluid transfers heat to the comburent air flow, heating it, and consequently returns to low temperature.

8. The heat engine (200) according to claim 1, provided with an auxiliary hydraulic circuit comprising:

an auxiliary recuperator (101), situated in the containment body of the heater in a position downstream of the burner (40), and preferably downstream of said superheater (96), along the outlet path of the hot combustion fumes of the heater;

a plurality of auxiliary pipes configured for traversing said auxiliary recuperator (101) and for being connected with one or more auxiliary uses, preferably space heating utilities and/or sanitary hot water production units;

an auxiliary pump (104), placed in said auxiliary hydraulic circuit and operatively active on a pipe of said plurality of auxiliary pipes for determining a circulation in said auxiliary circuit; and wherein said auxiliary recuperator (101) is configured for recovering energy from the combustion fumes and for transmitting it to the fluid circulating in said auxiliary circuit, said energy then being available for said auxiliary uses (103).

9. The heat engine (200) according to claim 1, wherein said energy transformation members are configured for transforming the energy of said thermal fluid into mechanical energy according to an operative cycle which provides for a sequence of steps of:

suctioning thermal fluid into said at least one operative chamber;

compressing the thermal fluid in said at least one operative chamber and pouring the thermal fluid;

loading thermal fluid in said at least one operative chamber and expanding the thermal fluid in said at least one operative chamber; and discharging thermal fluid from said at least one operative chamber.

10. The heat engine (200) according to claim 1, wherein said drive unit is a two-stroke engine or a four-stroke engine, or a reciprocating engine, or a rotary engine, and/or wherein said drive unit is a heat engine comprising a compressor, performing said suction and compression steps, and an expander, for example a turbine, performing said expansion and discharge steps.

11. The heat engine (200) according to claim 1, wherein said at least one operative chamber (3) comprises:

a first chamber (3A), provided with said first inlet and with said first outlet, in which the suction of the thermal fluid and the compressing of the thermal fluid occur;

a second chamber (3B), separate from said first chamber, provided with said second inlet and with said second outlet, in which the loading of the compressed thermal fluid, the expanding of the thermal fluid and the discharge of the thermal fluid occur, and wherein said drive unit is a drive unit with intermittent flow, where:

said first chamber is an operative chamber with variable volume, configured for operating a fluid suction and a fluid compression; and said second chamber is an operative chamber with variable volume, configured for operating a fluid expansion and a fluid discharge, or wherein said drive unit is a drive unit with continuous flow, where:

said first chamber is structured for attaining a compressor, configured for operating a fluid suction and a fluid compression; and said second chamber is structured for attaining a turbine, configured for operating a fluid expansion and a fluid discharge.

12. The heat engine (200) according to claim 1, wherein said thermal fluid is a mixture comprising a gas and water vapor or water, wherein said gas is preferably air and/or helium and/or other gaseous fluid compatible with the water vapor or the water, and said thermal cycle attained by the heat engine is a combined thermal cycle, and/or wherein the heat engine comprises an electric generator (G), e.g. an alternator, connected with said output shaft in a manner such to receive said rotary motion preferably at constant angular speed and generate electric current intended to power supply an external utility.

13. Method for attaining a thermal cycle, the method operating with a thermal fluid and comprising the steps of:

arranging a heat engine (200) according to claim 1;

executing the following steps:

starting said drive unit (1), moving said members for transforming the energy of said thermal fluid;

activating said heater (41) for heating the thermal fluid in said drive circuit (10);

activating an operative cycle comprising the steps of:

suctioning said thermal fluid into said at least one operative chamber (3) through said first inlet (4);

compressing said thermal fluid in said at least one operative chamber (3) and pouring said thermal fluid out from said first outlet (5);

heating the thermal fluid circulating in said second branch (12) of the drive circuit (10) by means of said heater (41);

loading said thermal fluid into said at least one operative chamber (3) through said second inlet (6) and expanding said thermal fluid in said at least one operative chamber (3);

discharging said thermal fluid from said at least one operative chamber (3) through said second outlet (7);

wherein said steps of the operative cycle of suctioning, compressing, loading and discharging the thermal fluid determine a transformation of the energy of said thermal fluid into mechanical energy; and transferring said mechanical energy generated by said transformation members to said output shaft (8), which provides a rotary motion at the outlet, preferably with constant angular speed.

14. The method according to claim 13, comprising the following steps:

the thermal fluid exiting from said second outlet (7) of the drive unit (1) moves into the second outlet duct (17) of the first branch (11) of the drive circuit (10) and traverses the high-temperature side of the vaporizer (95);

the thermal fluid continues into the first branch (11) and reaches the condenser (43) where it is cooled;

the thermal fluid continues into the first branch (11) and reaches the condensation separator (93) where the water present in the thermal fluid is condensed and separated from the air, before the thermal fluid reaches said first inlet (4) of the drive unit (1);

the condensation water previously extracted from the air by means of the condensation separator (93) is drawn and sent into a vaporization pipe (20) flowing into said second branch (12), at a point of said first outlet duct (15) upstream of the heater (41);

the condensation water circulating in the vaporization pipe (20) traverses the low-temperature side of the vaporizer (95), where it is heated and vaporized before it flows into said second branch (12) of the drive circuit; and a predefined quantity of water vapor is injected into the second branch (12), upstream of the heater (41), by means of the injector (97), said water vapor quantity being capable of increasing the unit power of the drive unit (1) and of ensuring the lubrication of said energy transformation members movably housed in said at least one operative chamber (3).

15. The method according to claim 13, comprising the following steps:

arranging said cooling circuit, comprising the first recuperator (98), the cooling unit (2R), the plurality of cooling pipes and the cooling pump (99);

executing the steps of:

the low-temperature cooling fluid interacts with the cooling unit (2R), where it draws heat from the case of the drive unit, cooling it, and consequently it is brought to high temperature;

the high-temperature cooling fluid interacts with the first heat recuperator (98), where it transfers heat to the comburent air flow, heating it, and consequently it is cooled and returns to low temperature; and activating the cooling pump (99) for determining the circulation of cooling fluid in the cooling circuit, and/or comprising the following steps:

arranging the second recuperator (100) in the cooling circuit; and executing the steps of:

in the cooling unit (2R), the low-temperature cooling fluid draws heat from the case of the drive unit, cooling it, and consequently it is brought to high temperature;

in the second heat recuperator (100), the high-temperature cooling fluid acquires heat from the hot combustion fumes, cooling them, and consequently undergoes a temperature increase; and in the first heat recuperator (98), the high-temperature cooling fluid transfers heat to the comburent air flow, heating it, and consequently it is cooled and returns to low temperature.

* * * * *